US012745847B2

(12) United States Patent
Verhoeven

(10) Patent No.: US 12,745,847 B2
(45) Date of Patent: Sep. 29, 2026

(54) DEPLOYABLE CHAIR

(71) Applicant: Dean Verhoeven, Wake Forest, NC (US)

(72) Inventor: Dean Verhoeven, Wake Forest, NC (US)

( * ) Notice: Subject to any disclaimer, the term of this patent is extended or adjusted under 35 U.S.C. 154(b) by 151 days.

(21) Appl. No.: 18/631,150

(22) Filed: Apr. 10, 2024

(65) Prior Publication Data

US 2025/0318647 A1 Oct. 16, 2025

(51) Int. Cl.

| | |
|---|---|
| ***A47C 1/14*** | (2006.01) |
| ***A47C 4/30*** | (2006.01) |
| ***A47C 4/52*** | (2006.01) |

(52) U.S. Cl.

CPC ..... *A47C 4/52* (2013.01); *A47C 1/14* (2013.01); *A47C 4/30* (2013.01)

(58) Field of Classification Search

CPC .. A47C 1/14; A47C 1/145; A47C 4/00; A47C 4/28; A47C 4/30; A47C 19/027; A47C 20/04; A47C 23/06; A47C 1/146; E06B 9/11; E06B 2009/1555; E06B 2009/1505

See application file for complete search history.

(56) References Cited

U.S. PATENT DOCUMENTS

| | | | | |
|---|---|---|---|---|
| 2,001,252 | A * | 5/1935 | Clarence | A47C 1/146 5/236.1 |
| 6,164,726 | A | 12/2000 | Reeves et al. | |
| 6,928,959 | B1 * | 8/2005 | Trauernicht | B65G 69/287 119/847 |
| 7,225,492 | B2 * | 6/2007 | Pratt | A63C 19/10 472/89 |
| 7,344,197 | B2 * | 3/2008 | Sanderson | F16G 13/16 5/722 |
| 7,958,586 | B1 * | 6/2011 | Carter | B65G 69/30 119/847 |
| 8,454,084 | B2 | 6/2013 | Lah | |
| 12,433,417 | B2 * | 10/2025 | Liechtenstein | A61G 7/0755 |
| 2006/0022494 | A1 * | 2/2006 | Sanderson | A47C 13/00 297/29 |
| 2023/0346130 | A1 * | 11/2023 | Liechtenstein | A61G 7/018 |

OTHER PUBLICATIONS

STEP2, "Flip Seat", (4 pages), available online at https://www.step2.com/products/flip-seat.

Crazy Creek, "HEX 2.0 Original Chair", (5 pages), available online at https://crazycreek.com/products/hex-2-0-original-chair?variant=44499742425404.

* cited by examiner

*Primary Examiner* — Philip J Bonzell

(74) *Attorney, Agent, or Firm* — Alston & Bird LLP

(57) ABSTRACT

Embodiments of the disclosure provide deployable seating systems. In the context of a chair, the chair includes a plurality of links pivotably connected to one another in a sequence, wherein each link comprises a central portion extending between opposing ends of the link, wherein the plurality of links are configured to at least partially unroll in a first direction to transition the apparatus from an undeployed orientation to a deployed orientation; and the pivotable connection between respective links embodying at least one pivot limiting element configured to limit the unrolling of the apparatus in the first direction.

13 Claims, 23 Drawing Sheets

DEPLOYABLE CHAIR

TECHNICAL FIELD

This application generally relates to transportable seating structures with pivot-limiting means for transitioning between undeployed and deployed orientations.

BACKGROUND

Existing approaches to portable chairs rely upon rigid structures that translate between expanded and collapsed orientations. For example, a common structure of beach and camping chairs include rigid struts ("legs") that rotate or translate to transition from a collapsed configuration to an expanded configuration for accommodating a seated subject. However, such chairs may demonstrate a significant spatial footprint in the collapsed configuration due to the rigidity of the leg structures. As a result, these approaches may demonstrate reduced carrying comfort. Other approaches to transportable seating surfaces include rollable mats formed of continuous sheets of flexible material. However, such surfaces may lack rigidity for supporting a seated subject's back. As a result, such approaches may prioritize transportability at the cost of subject comfort.

Thus, furniture makers have not yet solved the challenges of providing a highly transportable chair with minimal spatial footprint and adequate rigidity.

BRIEF SUMMARY

Embodiments of the present disclosure relate to apparatuses for deployable seating structures. An example seating apparatus may include a plurality of links pivotably connected to one another in a sequence, wherein each link comprises a central portion extending between opposing ends of the link, wherein the plurality of links are configured to at least partially unroll in a first direction to transition the apparatus from an undeployed orientation to a deployed orientation; and the pivotable connection between respective links embodying at least one pivot limiting element configured to limit the unrolling of the apparatus in the first direction. In some embodiments, the opposing ends of each of the plurality of links define, respectively, a first portion and a second portion that are positioned in parallel planes relative to one another, the parallel planes spaced apart relative to one another by a distance equal to a length of the central portion. In some embodiments, the at least one pivot limiting element comprises: a first set of tension elements secured at opposing ends and along a plurality of intermediary points of the first portion; and a second set of tension elements secured at opposing ends and along a plurality of intermediary points of the second portion, wherein the first and second set of tension elements maintain a maximum separation distance between the respective opposing ends of the first portion and the second portion.

In some embodiments, the at least one pivot limiting element comprises an angular stop formed between the respective links when the apparatus is transitioned to the deployed orientation. In some embodiments, the apparatus further includes a first portion having a first length defining opposing ends of the first portion; a second portion having a second length equal to the first length, the second length defining opposing ends of the second portion, wherein each of the first portion and the second portion comprises, respectively, a subset of the plurality of links comprising: a first terminal link pivotably connected to a first end of an inner sequence of links; a second terminal link pivotably connected to second end of the inner sequence of links, wherein the first and second terminal links define the opposing ends of the corresponding portion; and the inner sequence of links connected to one another via the angular stop such that each of the first and second portions are configured to at least partially unroll in the first direction via the plurality of links to transition the apparatus from the undeployed orientation to the deployed orientation; and the angular stop configured to limit a pivot angle of each of the at least one pivoting element such that the plurality of links prevent free unrolling of the apparatus in the first direction.

In some embodiments, the apparatus further includes a plurality of slats operatively connected to the first portion and the second portion along the first and the second lengths thereof respectively, such that the first portion and the second portion are positioned in parallel planes relative to one another, the parallel planes spaced apart relative to one another by a distance equal to a length of each of the plurality of slats.

Another example seating apparatus may include a first portion having a first length defining opposing ends of the first portion; a second portion having a second length equal to the first length, the second length defining opposing ends of the second portion, wherein each of the first portion and the second portion comprises, respectively, a plurality of links comprising: a first terminal link pivotably connected to a first end of an inner sequence of links; a second terminal link pivotably connected to second end of the inner sequence of links, wherein the first and second terminal links define the opposing ends of the corresponding portion; and the inner sequence of links pivotably connected to one another such that each of the first and second portions are configured to at least partially unroll in a first direction via the plurality of links to transition the apparatus from an undeployed orientation to a deployed orientation, wherein: the pivotable connection between each link comprises an angular stop configured to limit a pivot angle of the pivotable connection such that the plurality of links prevent free unrolling of the apparatus in the first direction; and a plurality of slats operatively connected to the first portion and the second portion along the first and the second lengths thereof respectively, such that the first portion and the second portion are positioned in parallel planes relative to one another, the parallel planes spaced apart relative to one another by a distance equal to a length of each of the plurality of rods.

In some embodiments, a respective end of each of the plurality of links embodies at least one ring; and the pivotable connection between respective links comprises an aligned arrangement of the at least one ring of each link, the aligned arrangement being maintained via a pin inserted through the aligned rings. In some embodiments, the apparatus further includes a carrying strap operatively connected to the first portion and the second portion, wherein the carrying strap comprises: at least one loop configured to secure over at least one of the first portion, the second portion, or the plurality of slats while the apparatus is in the undeployed orientation to prevent free unrolling of the first portion and the second portion. In some embodiments, the apparatus further includes a flexible cover secured over the plurality of slats; and a rigid handle integrated into an end of the flexible cover.

Another example seating apparatus may include a first portion having a first length defining opposing ends of the first portion; a second portion having a second length equal to the first length, the second length defining opposing ends of the second portion; and a plurality of central portions operatively connected to the first portion and the second portion along the first and the second lengths thereof respectively, such that the first portion and the second portion are positioned in parallel planes relative to one another, the parallel planes spaced apart relative to one another by a distance equal to a length of each of the plurality of central portions, wherein: each of the first portion and the second portion comprises: a plurality of segments between the opposing ends; and a plurality of sets of tension elements; and a respective set of tension elements is secured between adjacent segments of the plurality of segments, the respective set of tension elements being oppositely biased relative to one another; the first portion and the second portion are configured to at least partially unroll in a first direction to transition the apparatus from an undeployed orientation to a deployed orientation; and in the deployed orientation the opposite biasing of the respective sets of tension elements opposes free unrolling of the corresponding portion in the first direction.

In some embodiments, in the deployed orientation, the first set of tension elements and the second set of tension elements each maintain a maximum separation length between the opposing ends of the first portion and the second portion, respectively. In some embodiments, the plurality of segments of the first portion comprises a first plurality of interlocking links that extend along the first length between the opposing ends of the first portion; and the plurality of segments of the second portion comprises a second plurality of interlocking links that extend along the second length between the opposing ends of the first portion.

In some embodiments, the opposing ends of the first portion comprise a first end and a second end, the first and the second ends being embodied, respectively, by a first link of the first plurality of interlocking links and a second link of the first plurality of interlocking links; and the opposing ends of the second portion comprise a first end and a second end, the first and the second ends being embodied, respectively, by a first link of the second plurality of interlocking links and a second link of the second plurality of interlocking links. In some embodiments, each of the plurality of central portions is operatively connected to a respective pair of links from the first and the second plurality of interlocking links. In some embodiments, each of the plurality of central portions embodies a rod; and a respective rod of the plurality of rods embodies a multi-layer cylinder comprising: a structural layer; and a cushioning layer surrounding the structural layer.

In some embodiments, the respective sets of tension elements of the first and the second portion each comprise a plurality of cords secured between the opposing ends, wherein each of the plurality of cords of each tension element is separated from one another by a separation distance. In some embodiments, the apparatus further includes a first support leg attached to the first portion; and a second support leg attached to the second portion at a position parallel to the first support leg attached to the first portion, wherein: each of the first support leg and the second support leg are rotatable between a first position that is perpendicular to the corresponding portion and a second position that is parallel to the corresponding portion; and the first support leg and the second support leg are configured to be rotated to the second position while the apparatus is in the deployed orientation.

In some embodiments, the first plurality of links and the second plurality of links comprise, respectively: a first subset of links for defining a seating portion of the apparatus in combination with a corresponding first subset of the plurality of rods; and a second subset of links that define a backrest portion of the apparatus in combination with a corresponding second subset of the plurality of rods. In some embodiments, a quantity of links in the second subset of links exceeds a quantity of links in the first subset of links. In some embodiments, the first portion and the second portion further comprise, respectively: a third set of integrally formed links between the first plurality of links and the second plurality of links.

BRIEF DESCRIPTION OF THE FIGURES

Figures 1A, 1B:
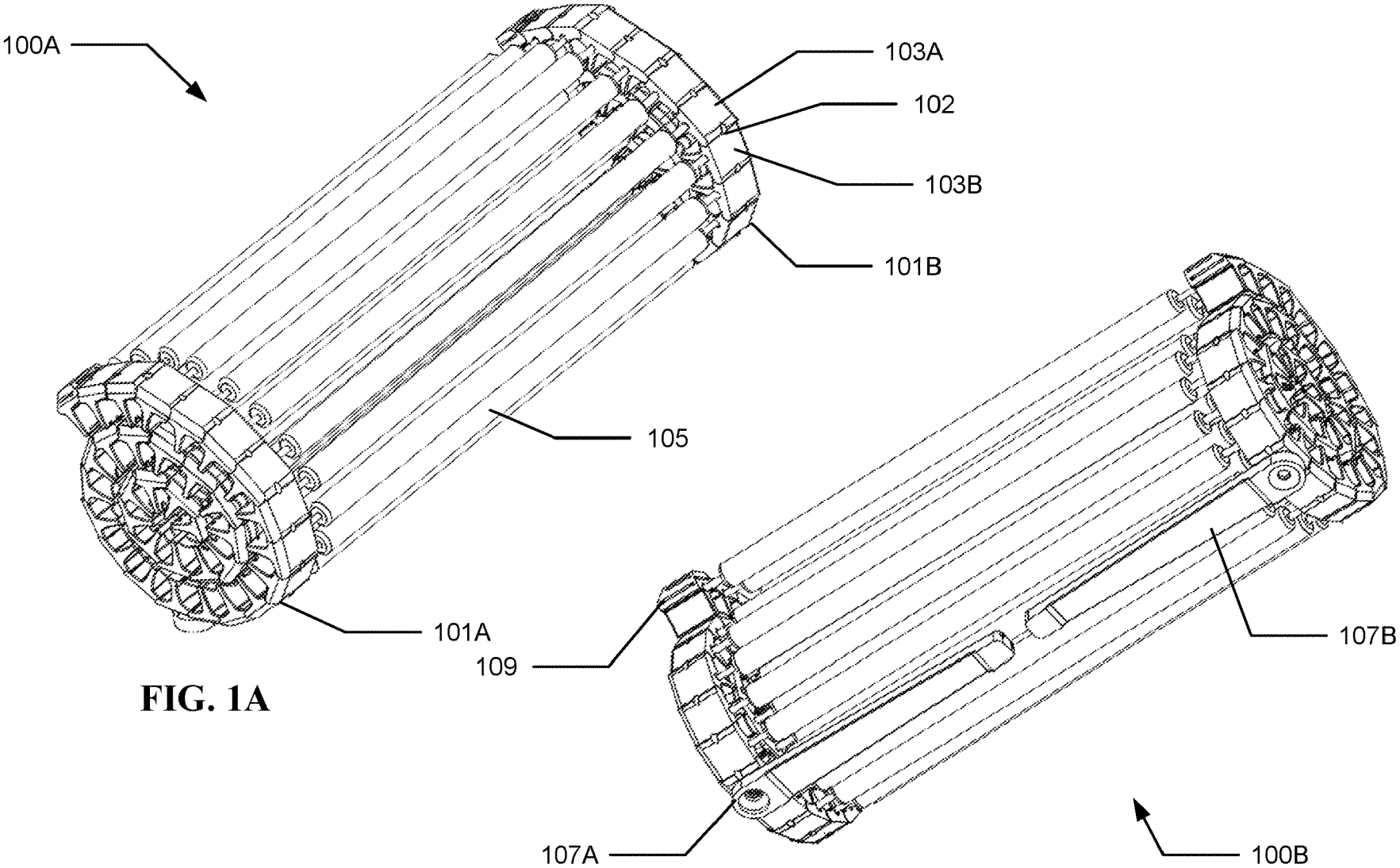
Figure 2B:
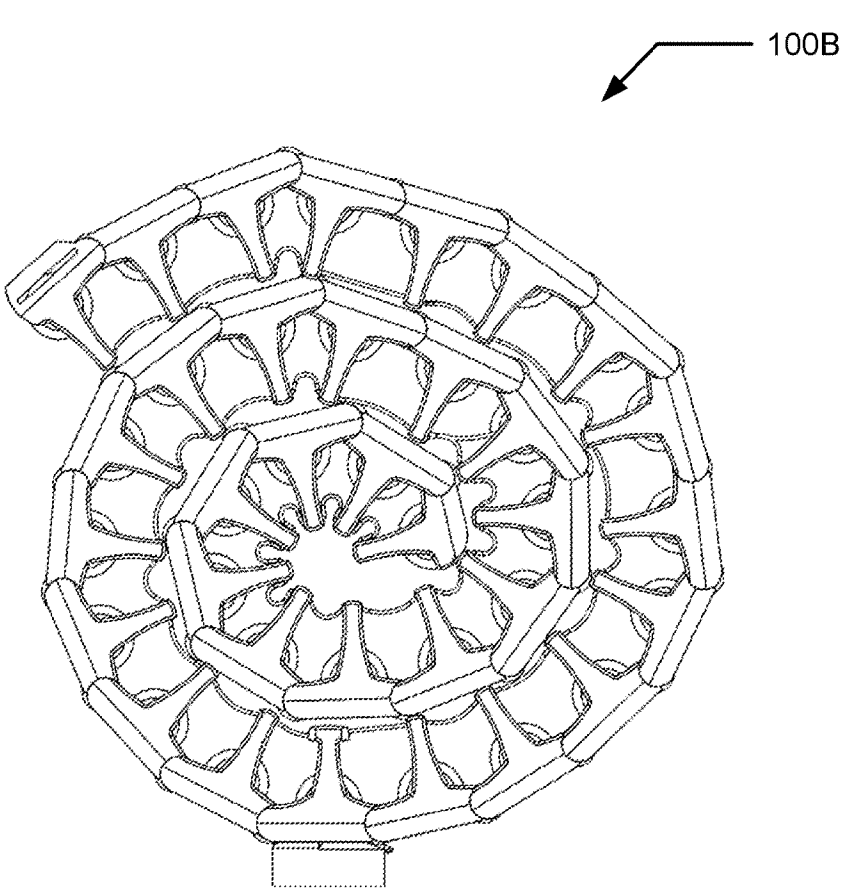
Figure 2A:
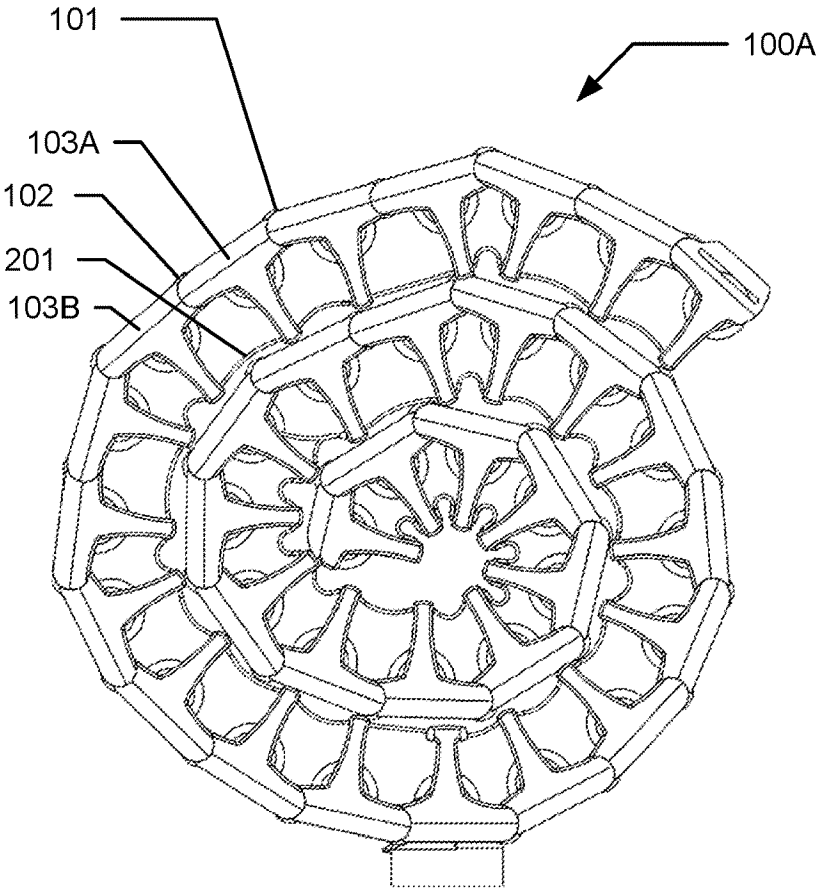
Figure 3D:
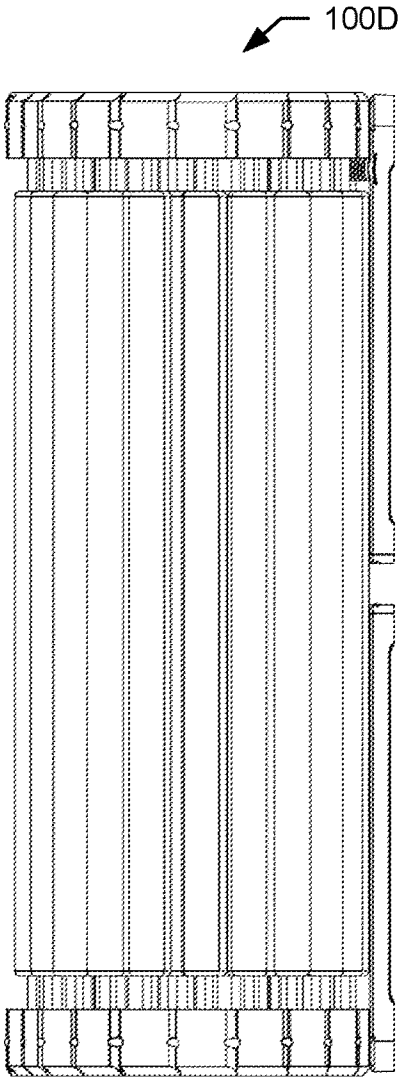
Figure 3C:
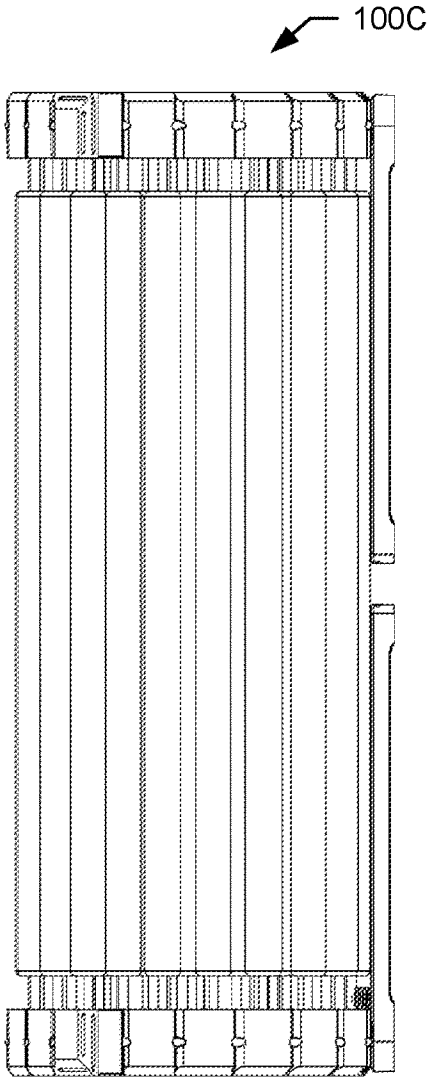
Figure 3B:
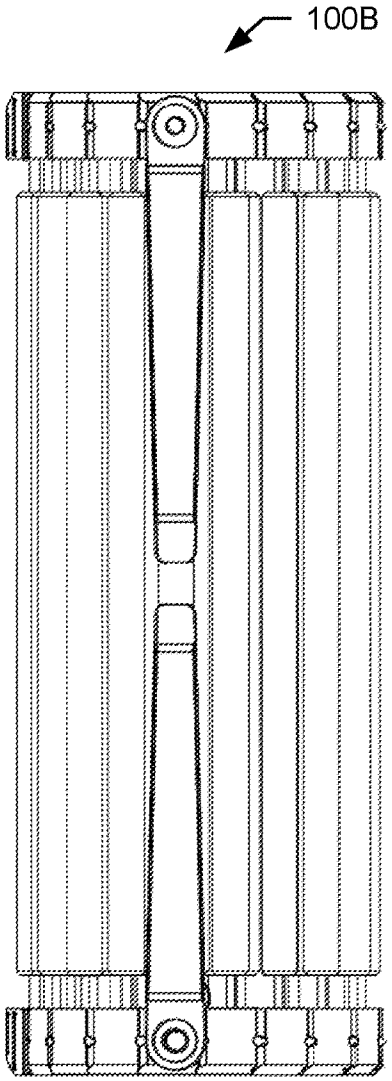
Figure 3A:
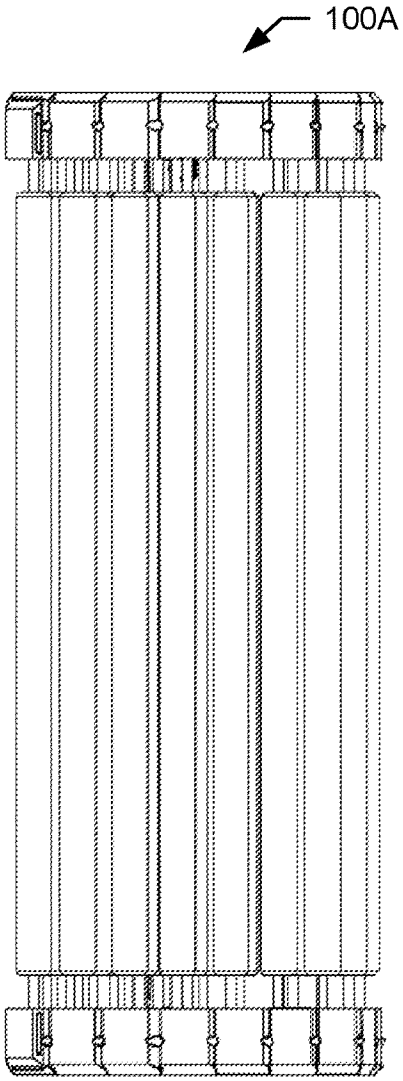
Figure 4B:
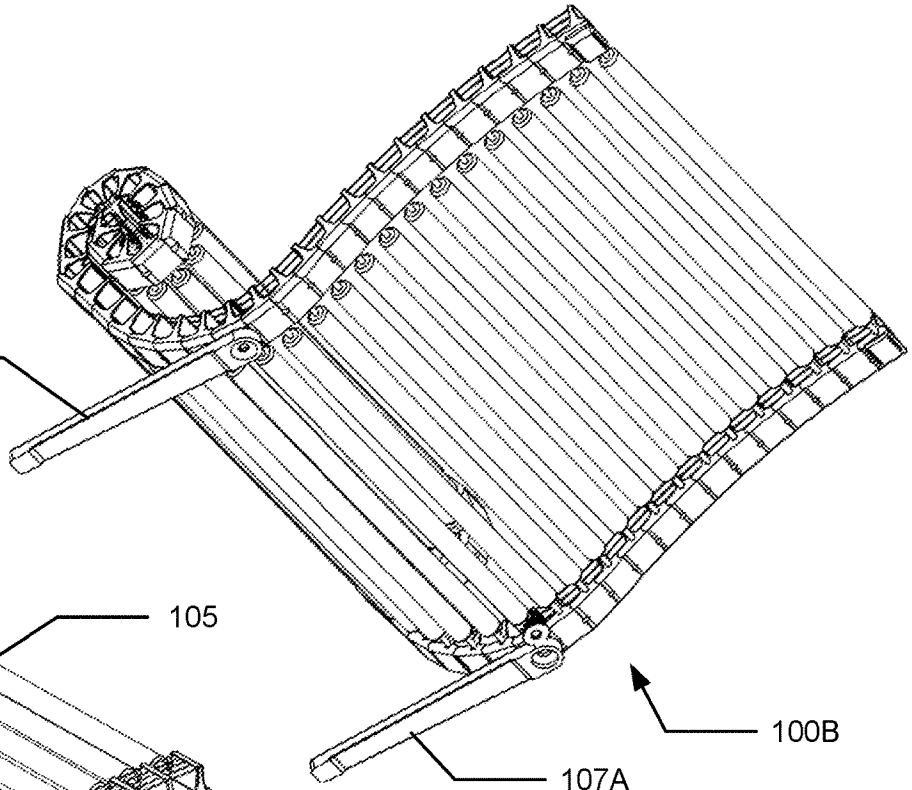
Figure 4A:
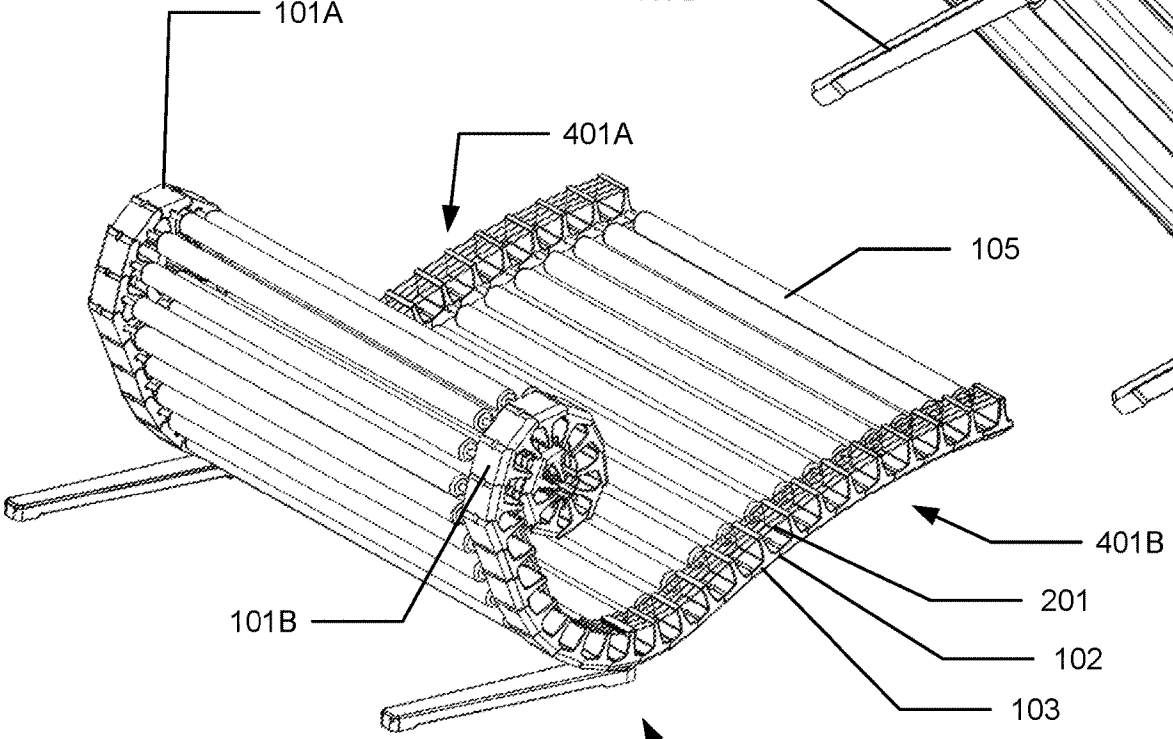
Figure 5A:
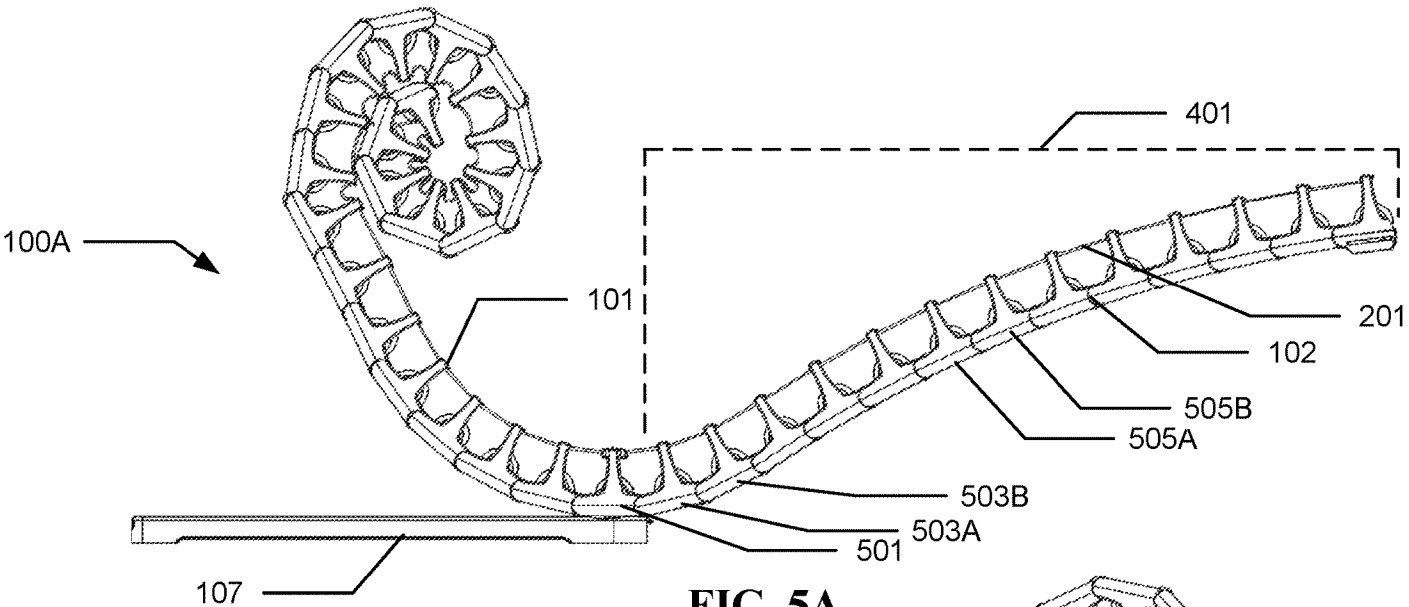
Figure 5B:
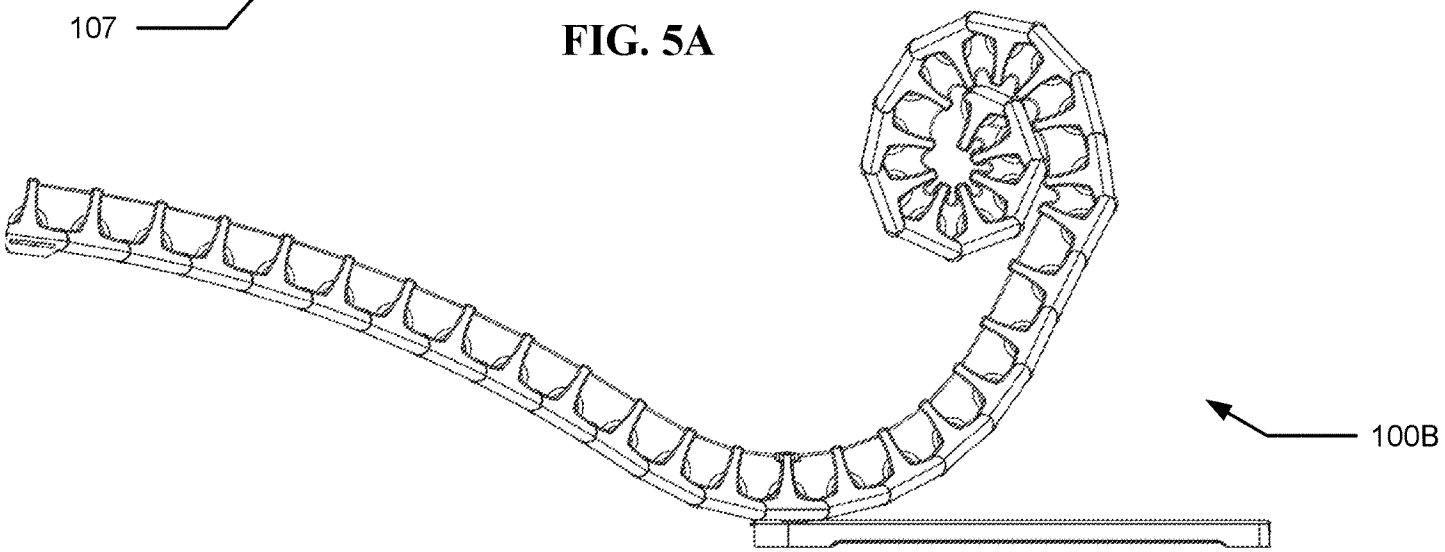
Figure 6A:
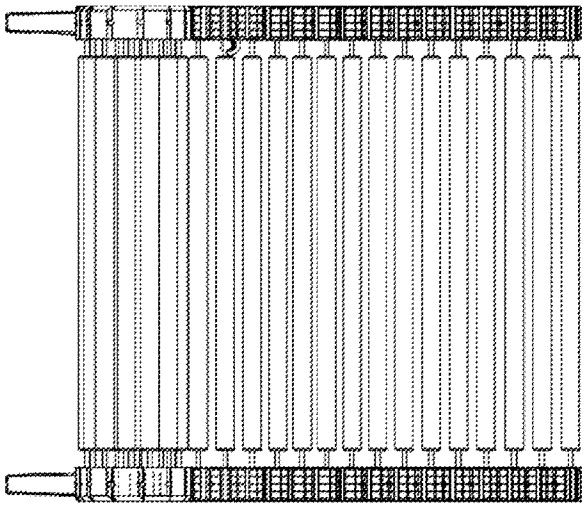
Figure 6B:
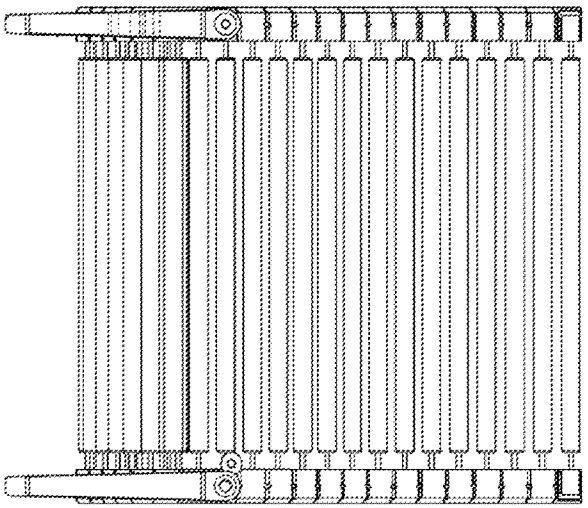
Figure 6C:
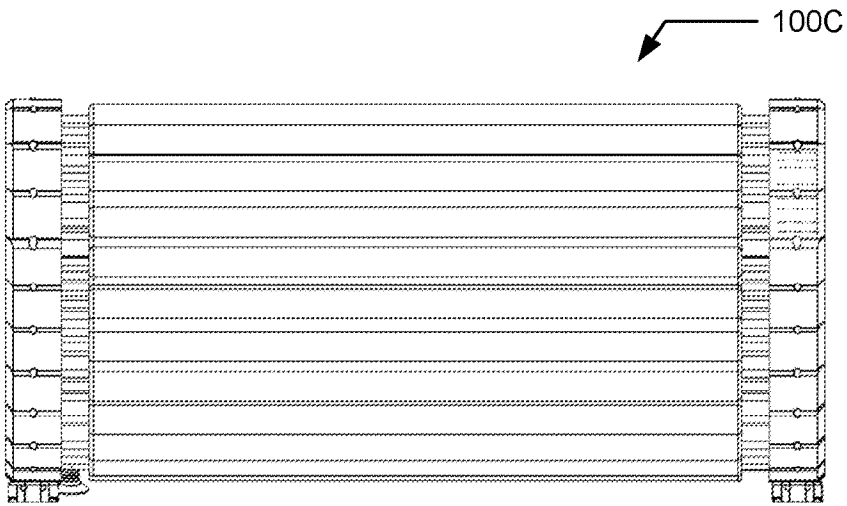
Figure 6D:
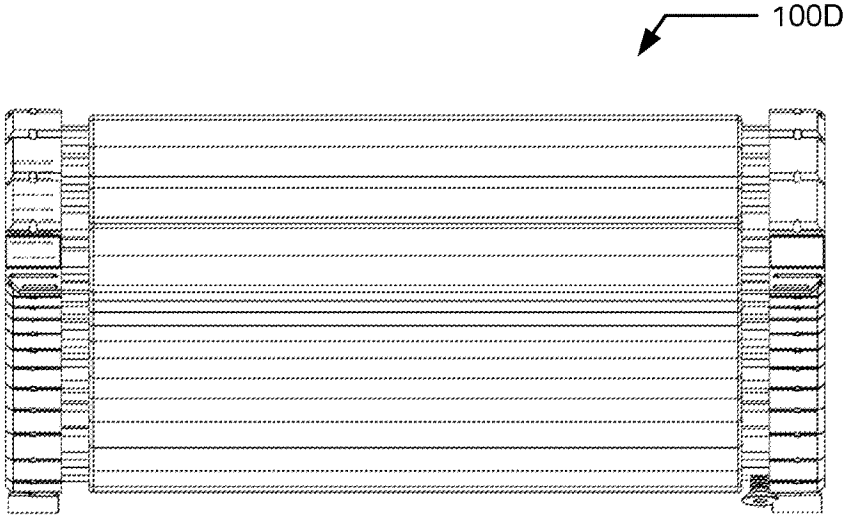
Figure 7:
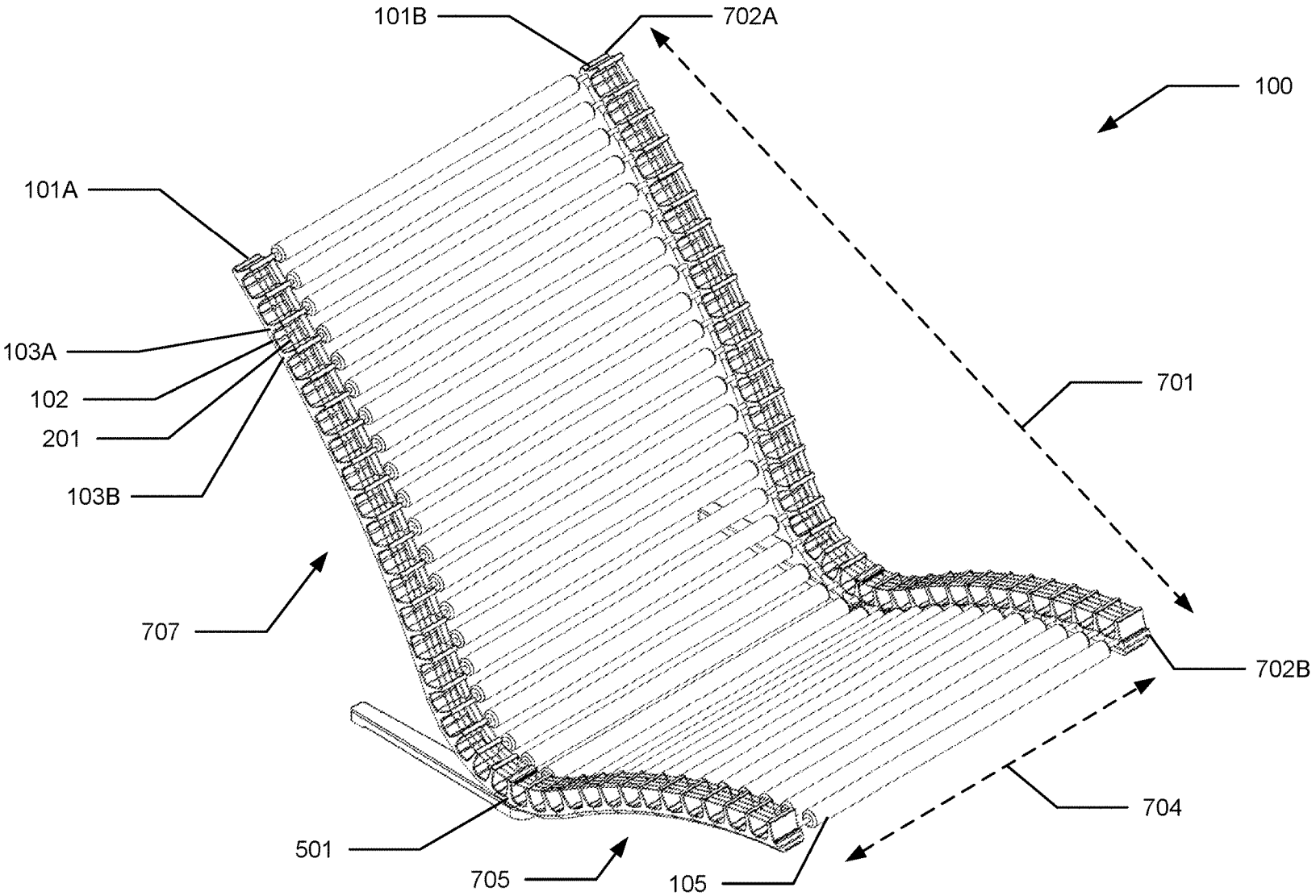
Figure 8:
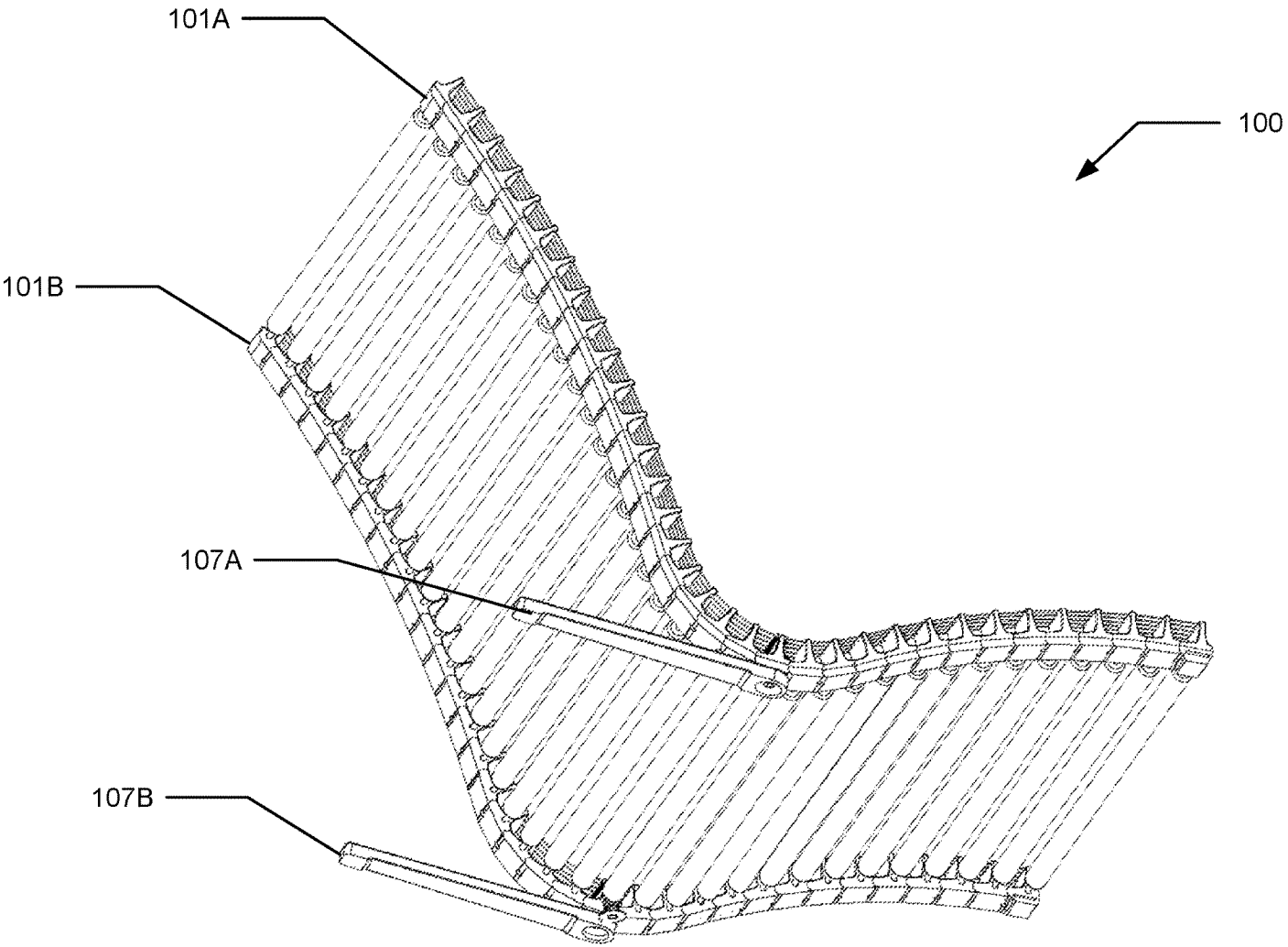
Figure 9:
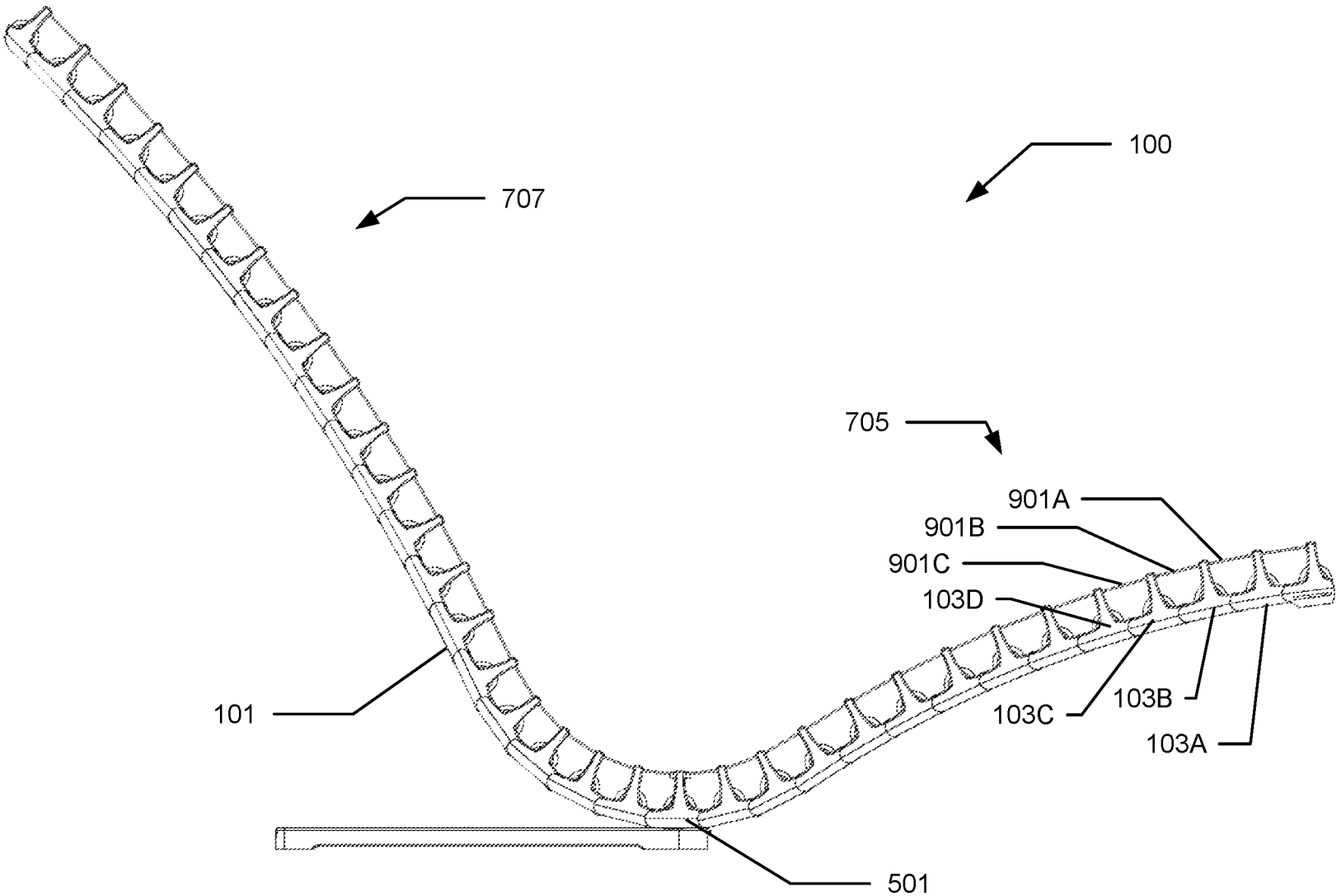
Figure 10B:
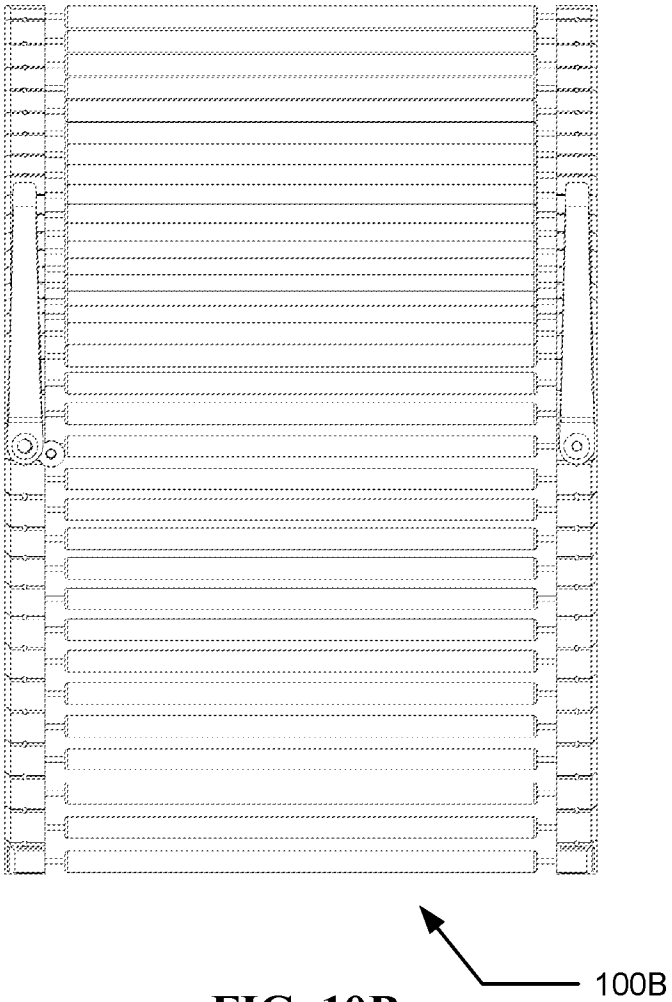
Figure 10A:
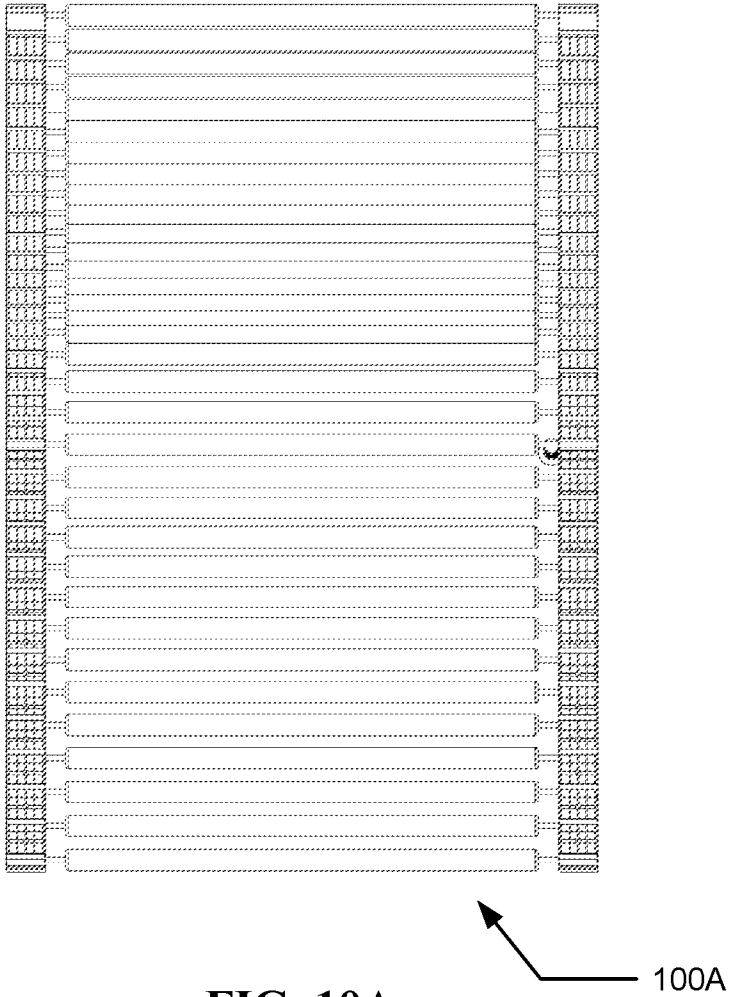
Figure 11B:
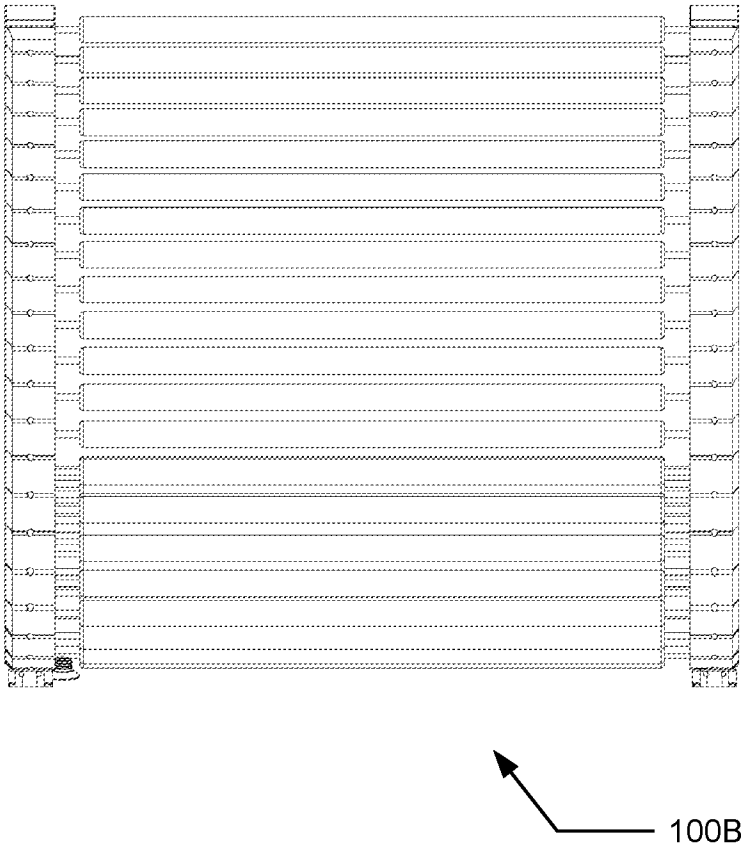
Figure 11A:
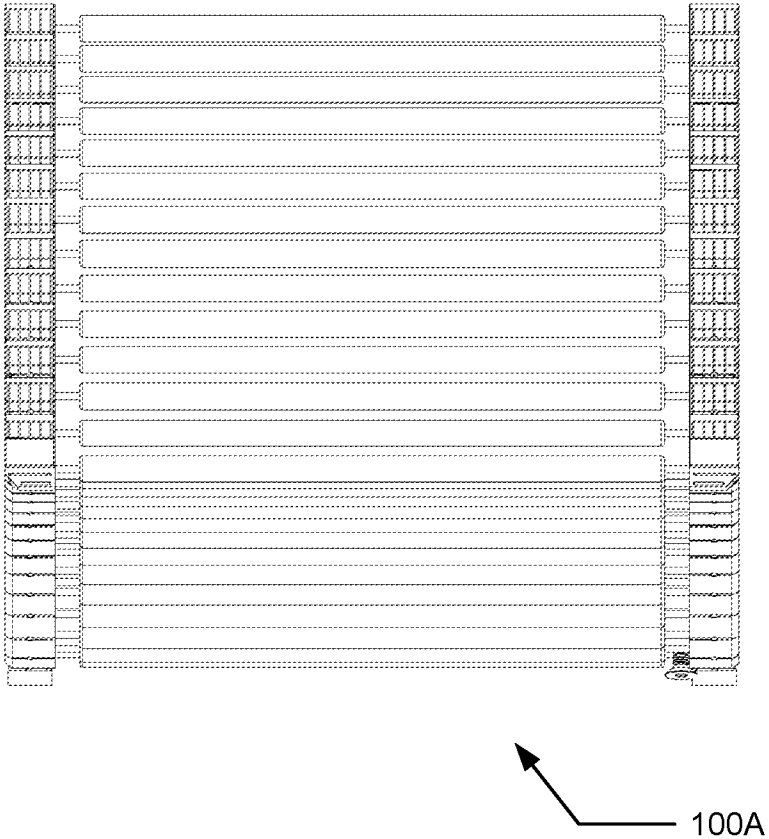
Figure 12:
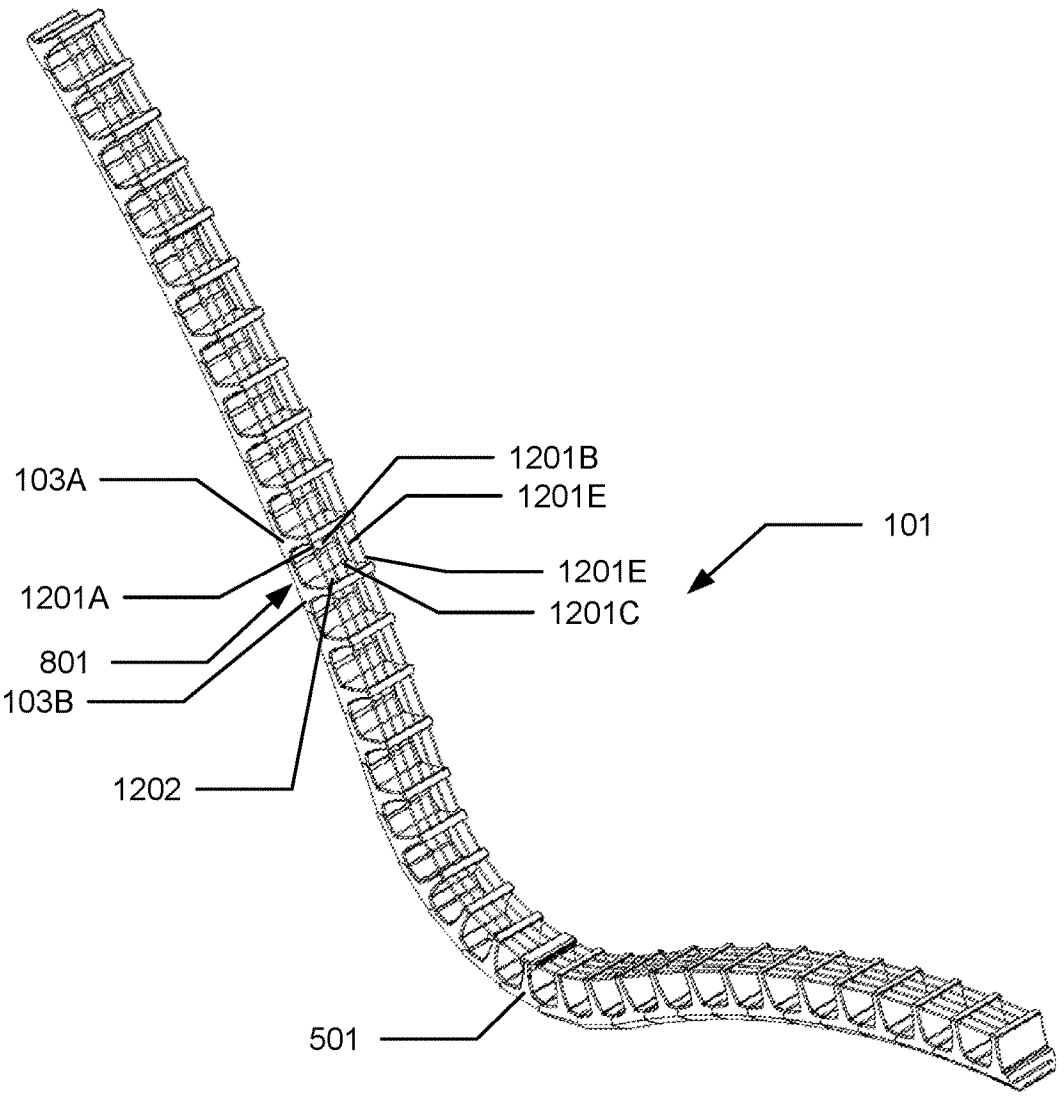
Figure 13A:
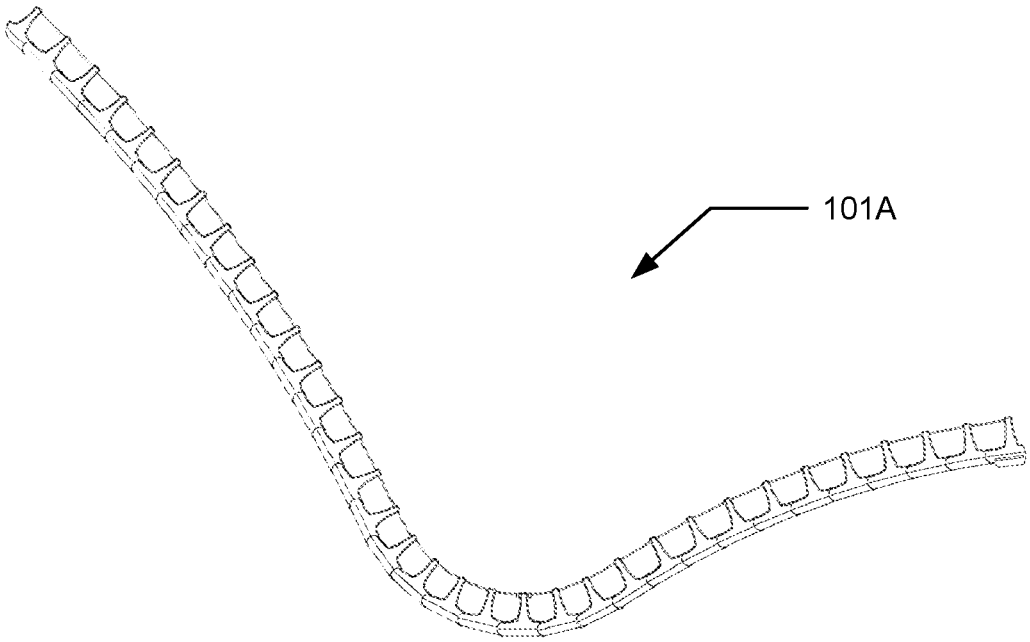
Figure 13B:
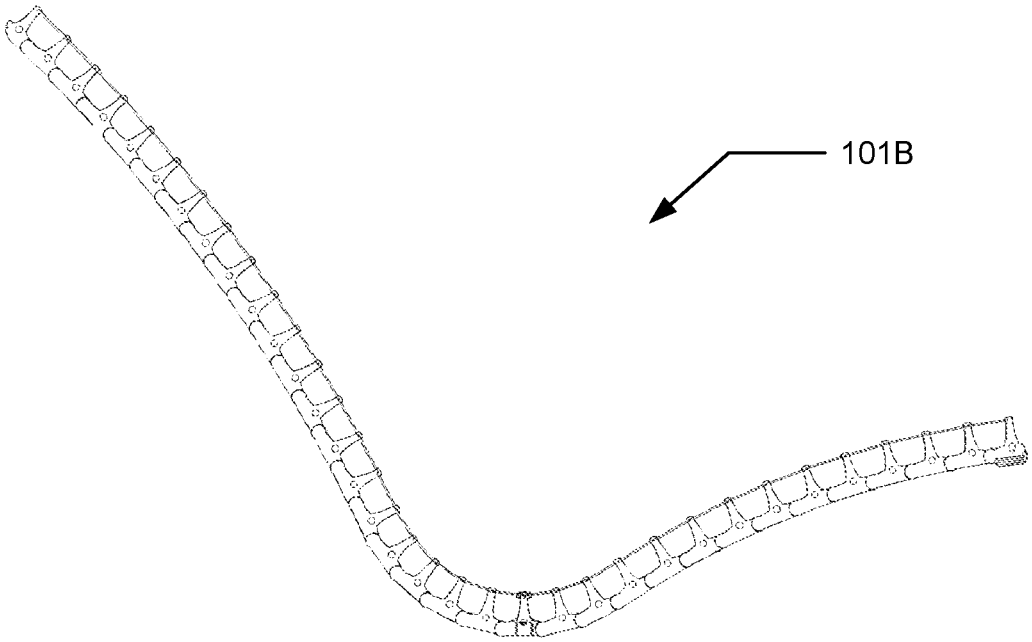
Figure 14A:
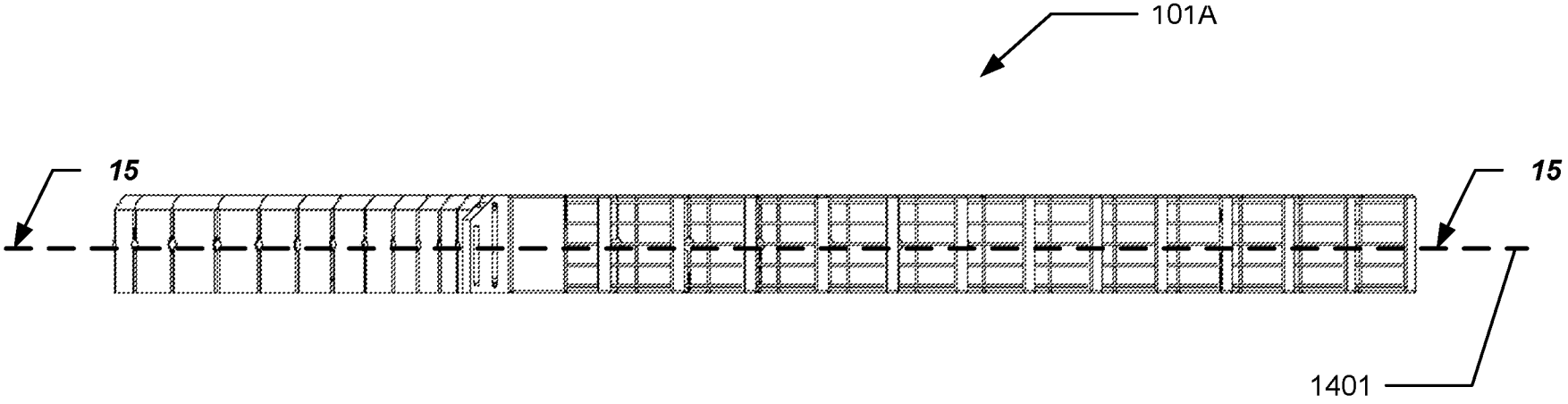
Figure 14B:
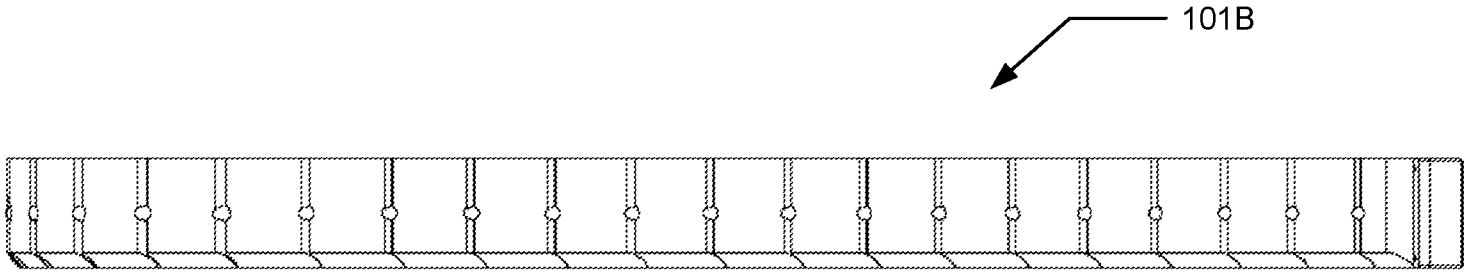
Figure 15:
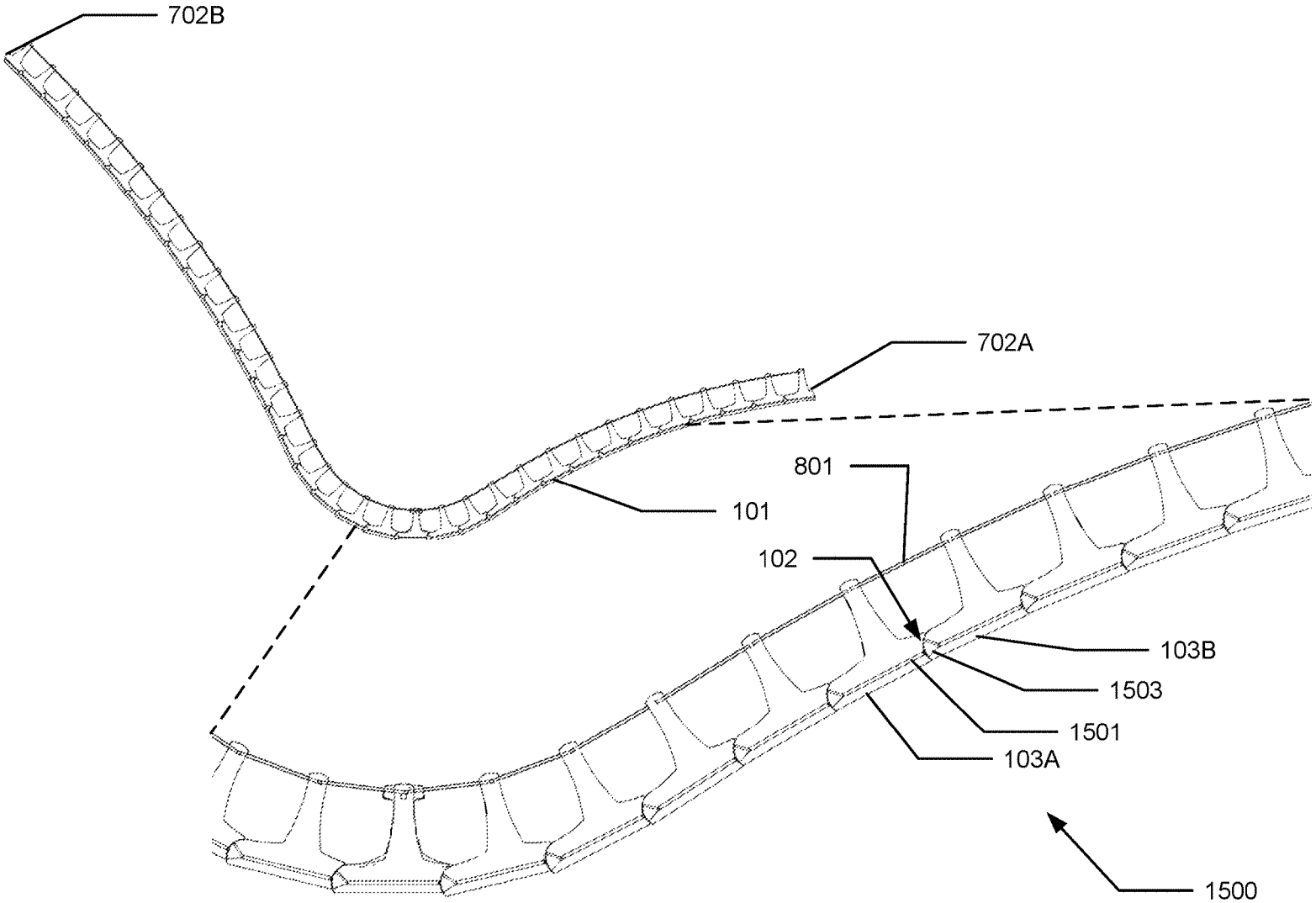
Figure 16:
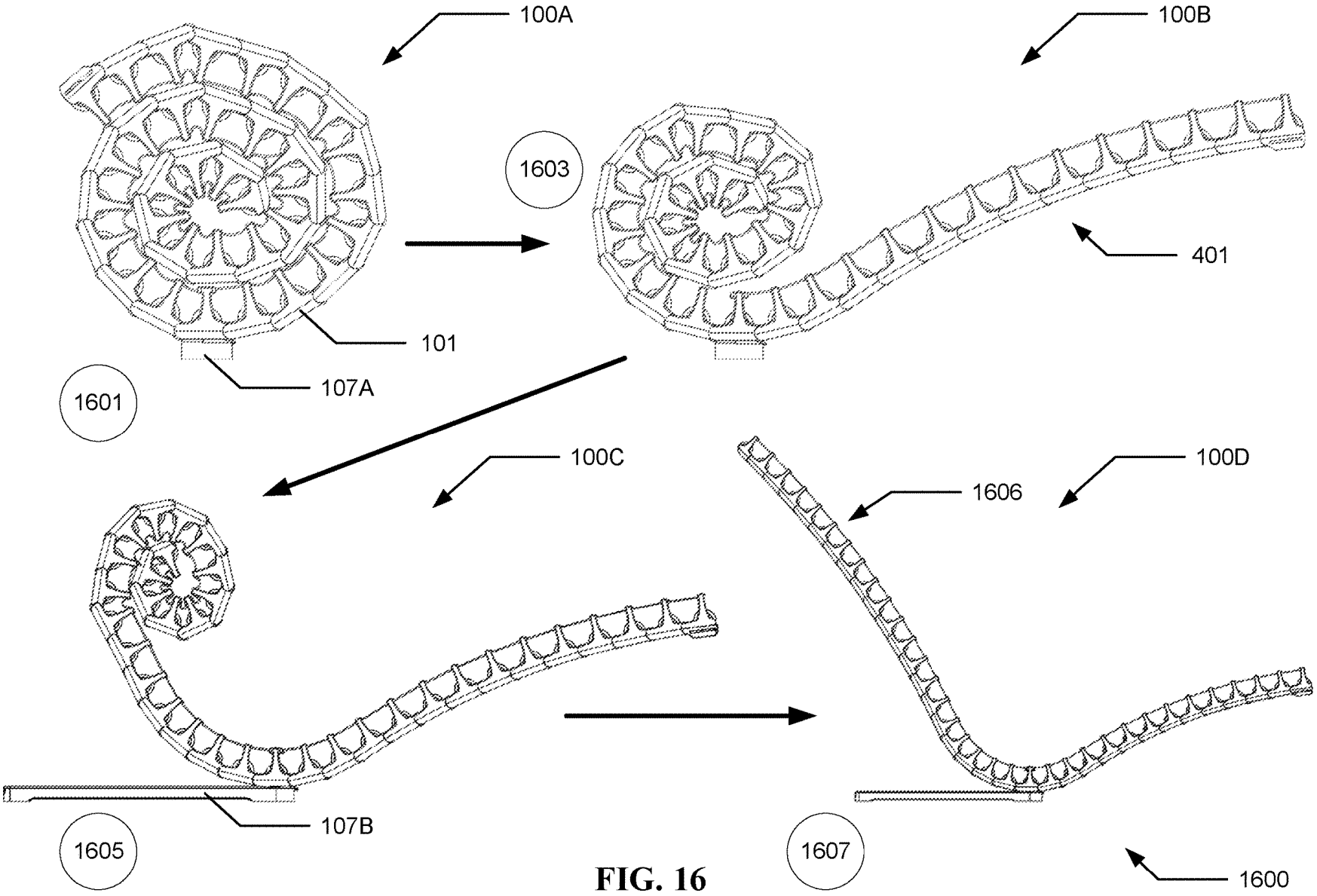
Figures 17A, 17B:
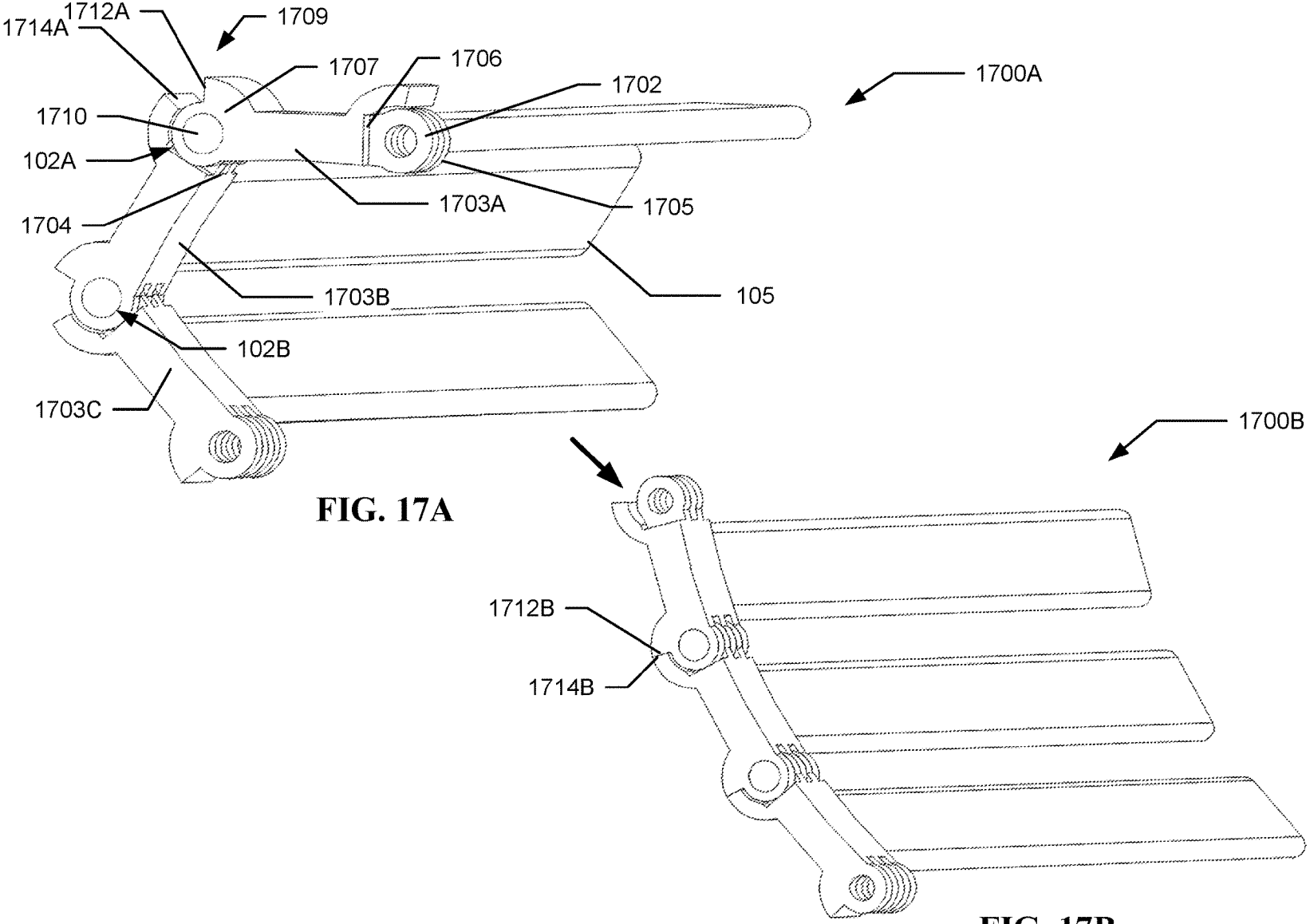
Figure 18B:
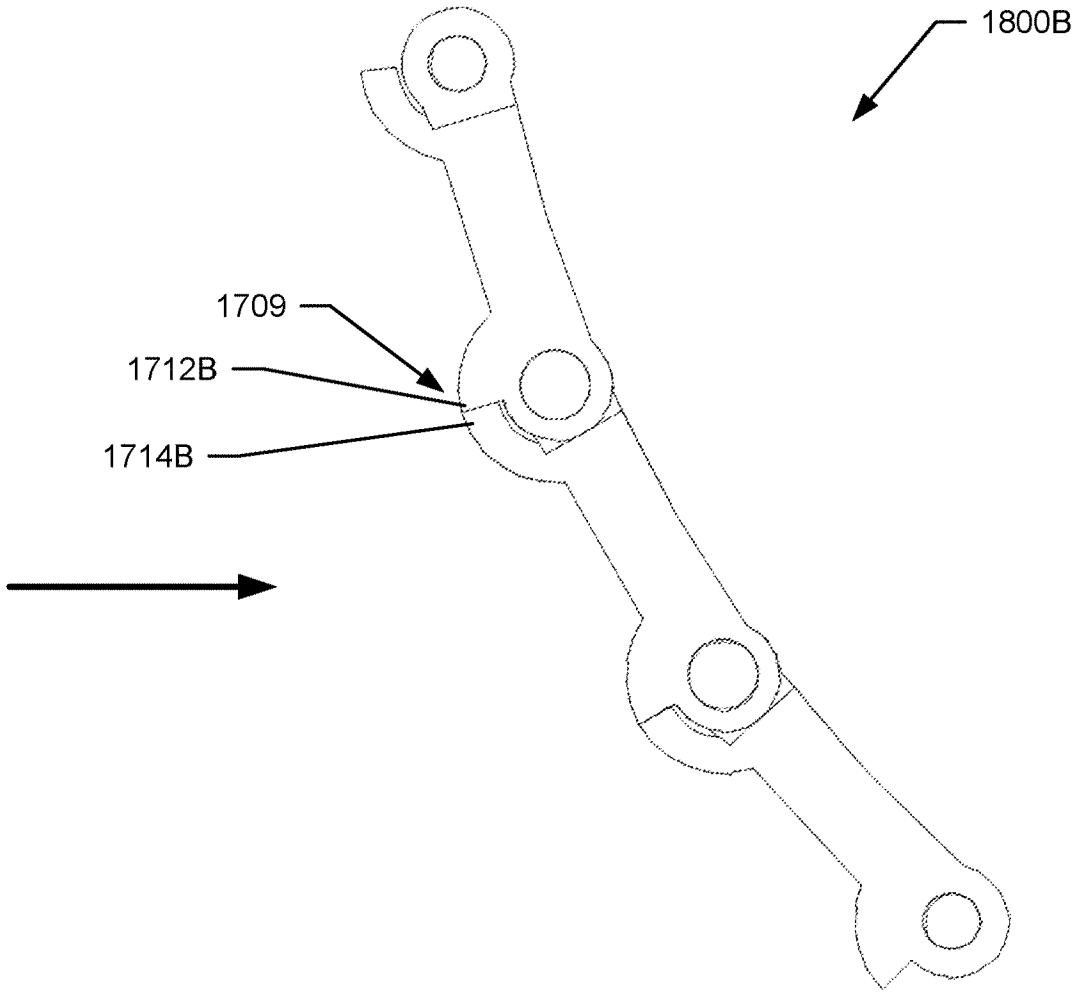
Figure 18A:
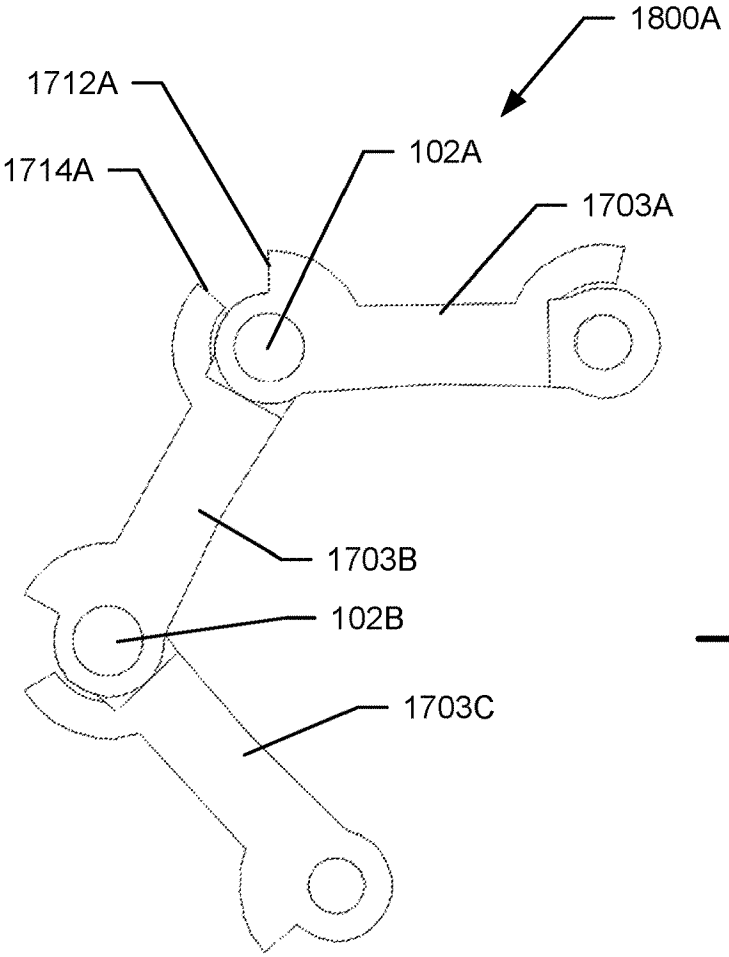
Figure 19:
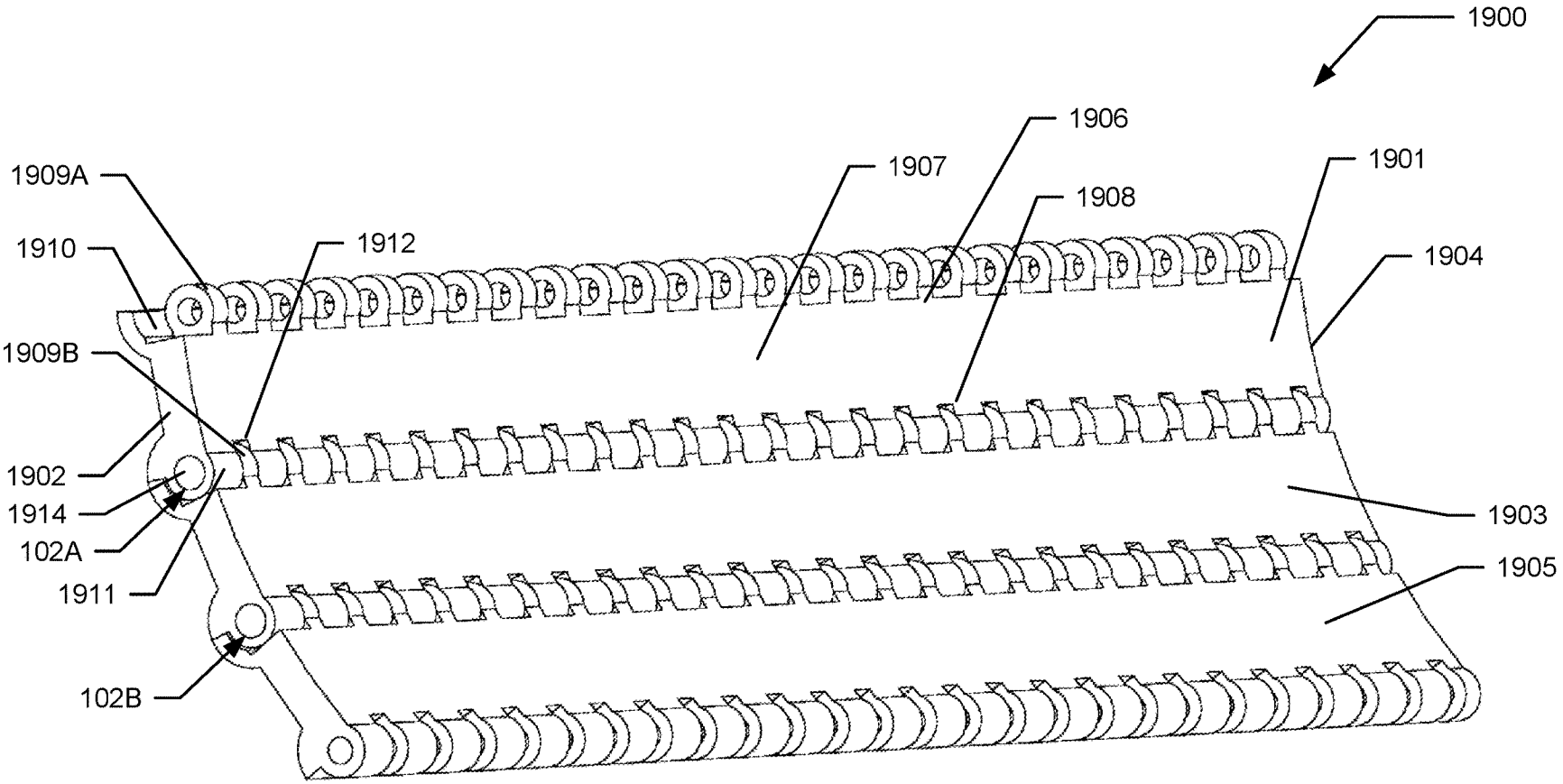
Figure 20:
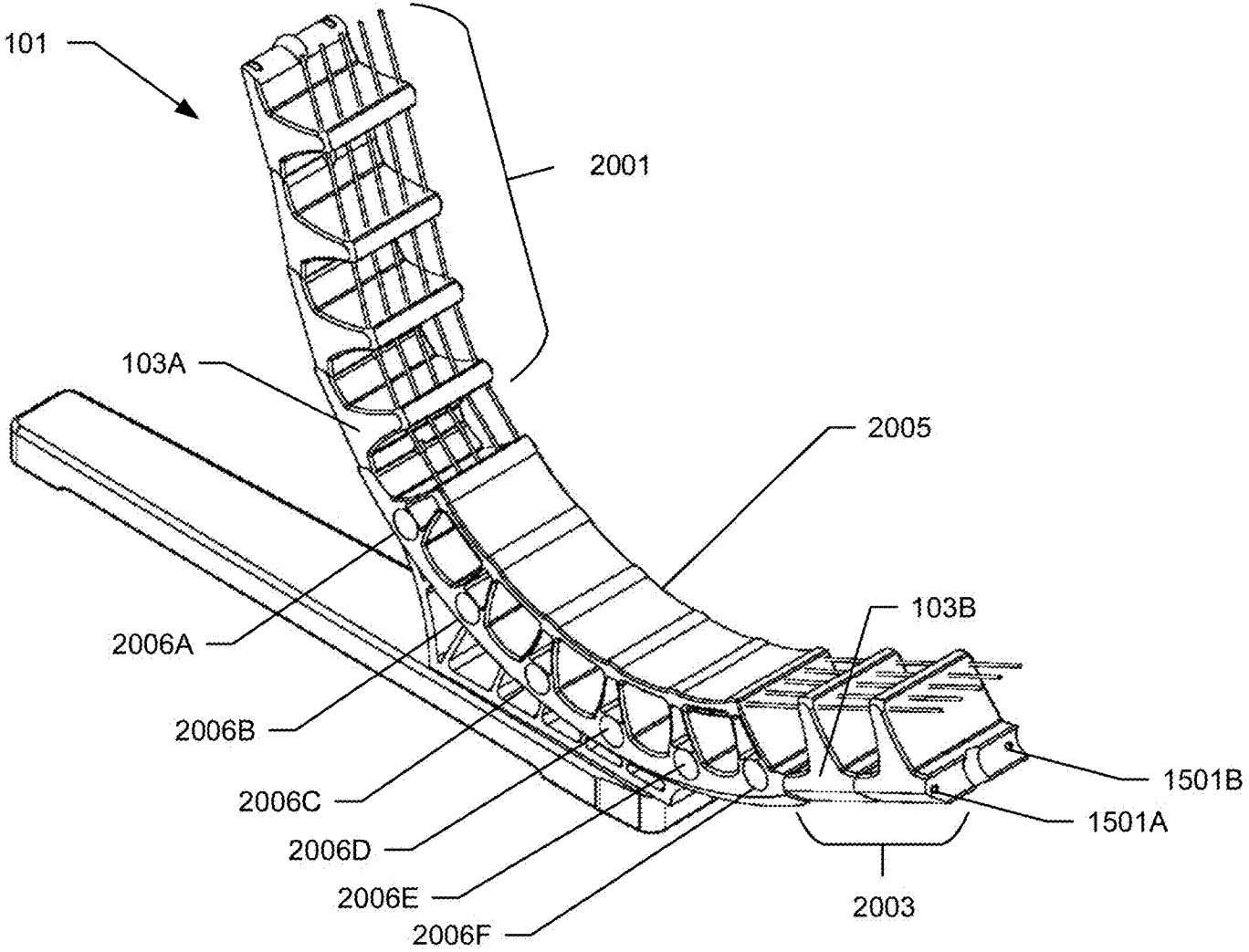
Figures 21A, 21B:
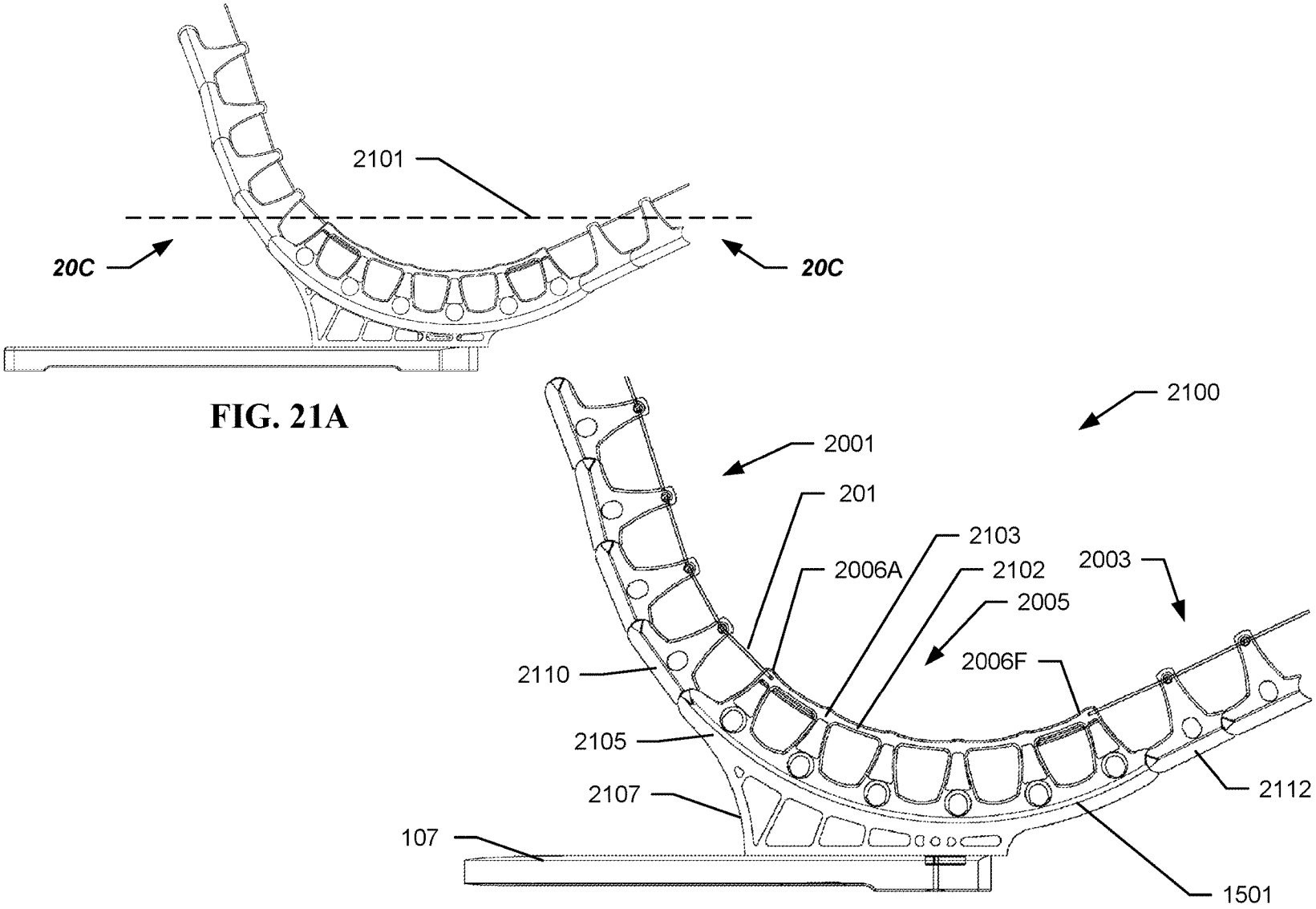
Figure 22A:
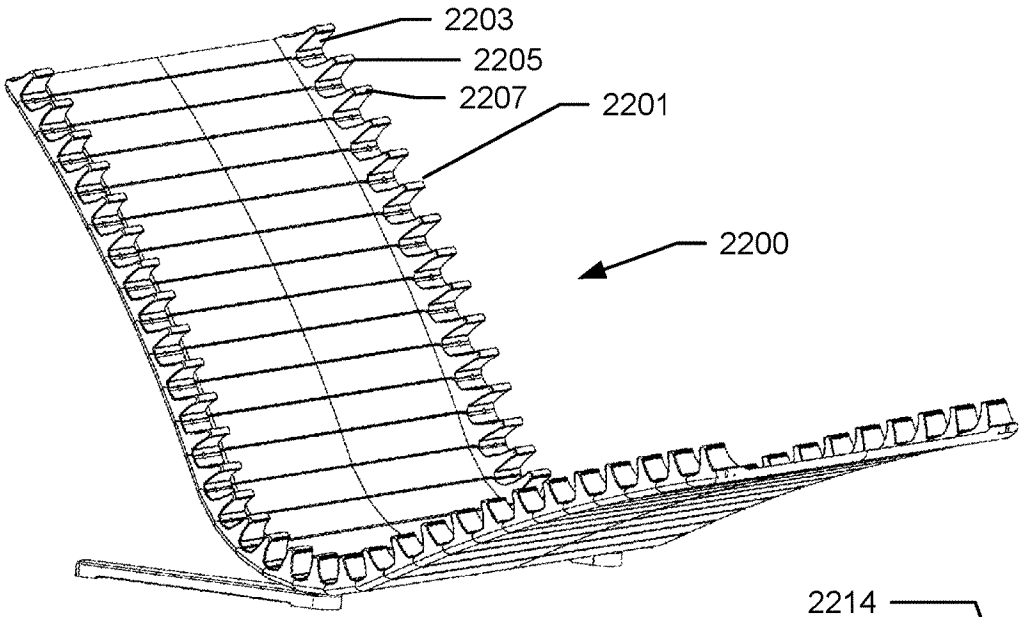
Figure 22B:
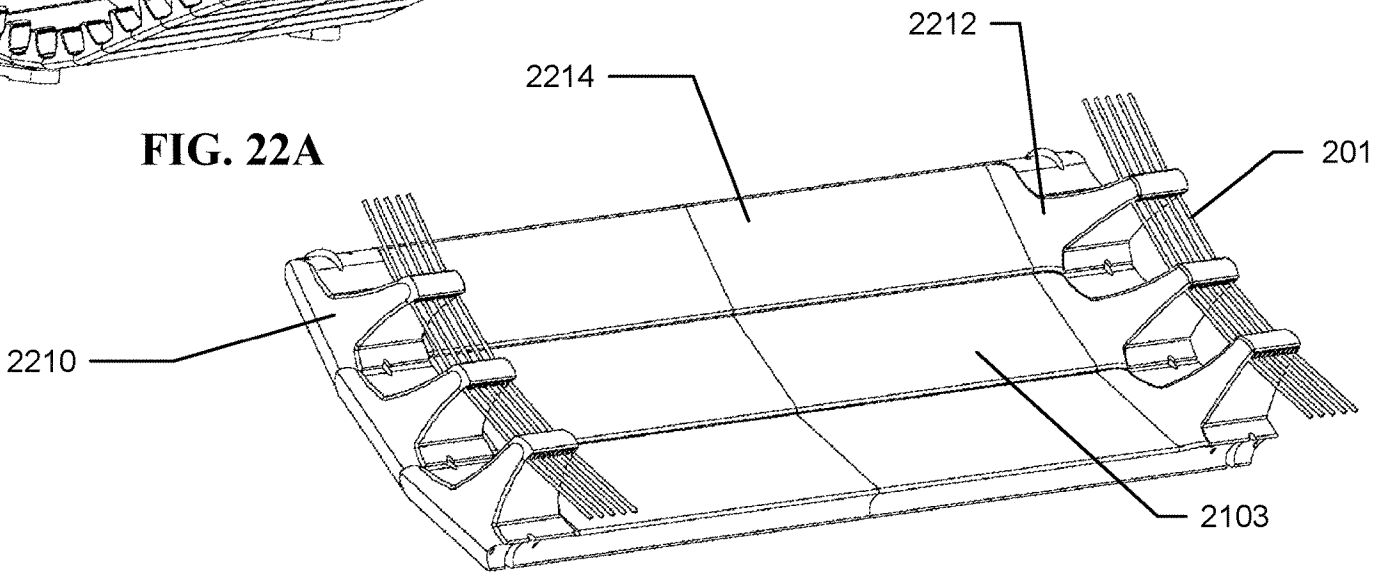
Figure 23:
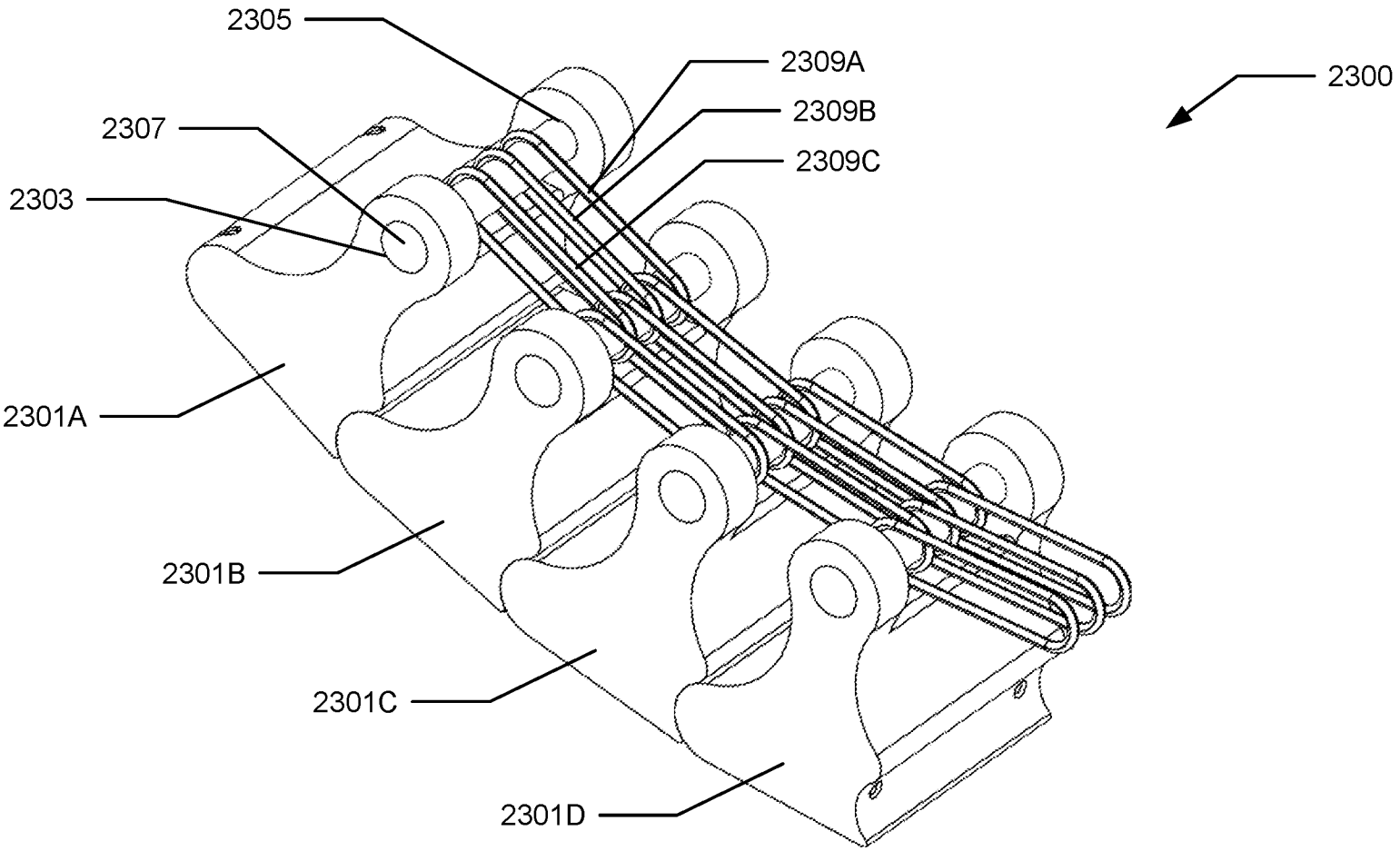

Having thus described the embodiments of the disclosure in general terms, reference now will be made to the accompanying drawings, which are not necessarily drawn to scale, and wherein:

FIGS. 1A-B show, respectively, a top perspective view and a bottom perspective view of an example chair in an undeployed orientation in accordance with at least some embodiments of the present disclosure;

FIGS. 2A-B show, respectively, a left-side view and a right-side view of an example chair in an undeployed orientation in accordance with at least some embodiments of the present disclosure;

FIGS. 3A-D show, respectively, top, bottom, front, and back views of an example chair in an undeployed orientation in accordance with at least some embodiments of the present disclosure;

FIGS. 4A-B show, respectively, a top perspective view and a bottom perspective view of an example chair in a partially deployed orientation in accordance with at least some embodiments of the present disclosure;

FIGS. 5A-B show, respectively, a left-side view and a right-side view of an example chair in a partially deployed orientation in accordance with at least some embodiments of the present disclosure;

FIGS. 6A-D show, respectively, top, bottom, front, and back views of an example chair in a partially deployed orientation in accordance with at least some embodiments of the present disclosure;

FIG. 7 shows a top perspective view of an example chair in a deployed orientation in accordance with at least some embodiments of the present disclosure;

FIG. 8 shows a bottom perspective view of an example chair in a deployed orientation in accordance with at least some embodiments of the present disclosure;

FIG. 9 shows a side view of an example chair in a deployed orientation in accordance with at least some embodiments of the present disclosure;

FIGS. 10A-B show, respectively, a top and bottom view of an example chair in a deployed orientation in accordance with at least some embodiments of the present disclosure;

FIGS. 11A-B show, respectively, a front and back view of an example chair in a deployed orientation in accordance with at least some embodiments of the present disclosure;

FIG. 12 shows a perspective view of a portion of an example chair in a deployed orientation in accordance with at least some embodiments of the present disclosure;

FIGS. 13A-B show, respectively, a left-side view and a right-side view of a portion of an example chair in a deployed orientation in accordance with at least some embodiments of the present disclosure;

FIGS. 14A-B show, respectively, a top view and a bottom view of a portion of an example chair in a deployed orientation in accordance with at least some embodiments of the present disclosure;

FIG. 15 shows a cross-section of a portion of an example chair in a deployed orientation in accordance with at least some embodiments of the present disclosure;

FIG. 16 shows a deployment sequence of an example chair in accordance with at least some embodiments of the present disclosure;

FIGS. 17A-B show, respectively, perspective views of an example portion of a chair in undeployed and deployed orientations in accordance with at least some embodiments of the present disclosure;

FIGS. 18A-B show, respectively, side views of an example portion of a chair in undeployed and deployed orientations in accordance with at least some embodiments of the present disclosure;

FIG. 19 shows a perspective view of an example portion of a chair in a deployed orientation in accordance with at least some embodiments of the present disclosure;

FIG. 20 shows a perspective view of an example portion of a chair in a deployed orientation in accordance with at least some embodiments of the present disclosure;

FIGS. 21A-B show, respectively, a side view and cross-section of an example portion of a chair in a deployed orientation in accordance with at least some embodiments of the present disclosure;

FIGS. 22A-B show perspective views of an example chair and portion thereof in a deployed orientation in accordance with at least some embodiments of the present disclosure; and FIG. 23 shows a perspective view of an example portion of a chair in accordance with at least some embodiments of the present disclosure.

DETAILED DESCRIPTION

In general, various embodiments of the present disclosure provide improved transportable seating systems. For purposes of describing and illustrating exemplary aspects of the seating systems, the proceeding description is presented in the context of chairs and pivot-limiting mechanisms thereof that are shown in the accompanying figures. It will be understood and appreciated that such context is provided by way of example and uses of the system in additional contexts, such as with other furniture, are contemplated and within the scope of the invention.

In various embodiments, a deployable seating apparatus of the present disclosure enables a user to convert a chair between an undeployed orientation for carrying and a deployed orientation for seating. For example, a user may configure the seating apparatus to the undeployed orientation and transport and carry the seating apparatus to a target site, such as a beach, park, venue, and/or the like. At the target site, the user may transition the seating apparatus to the deployed orientation such that the seating apparatus may accommodate and support the user in a reclined seating position.

In the undeployed orientation, the seating apparatus may demonstrate a reduced spatial footprint. For example, the seating apparatus may be rolled from a generally planar shape into a substantially cylindrical shape. In doing so, the seating apparatus may be more easily carried and stowed as compared to existing seating approaches, such as folding chairs and/or the like. In the deployed orientation, the seating apparatus may comprise a curved, planar shape such that the seating apparatus conforms to a profile of a seated user. For example, the seating apparatus may be unrolled from a substantially cylindrical shape to a generally planar shape comprising concave and convex curvatures for accommodating a seated user.

In various embodiments, the seating apparatus includes pivotable connections that enable transitions of the seating apparatus between the undeployed and deployed orientations. The pivotable connections may comprise pivot limiting mechanisms that prevent free unrolling of the seating apparatus beyond the deployed orientation. For example, a respective pivotable connection may pivot within a predetermined angular range, where a maximum value of the angular range is associated with the seating apparatus being configured to the deployed orientation. The pivot limiting mechanism may maintain the shape of the seating apparatus in the deployed orientation by constraining the respective pivotable connection to the maximum angular value. In doing so, the seating apparatus may demonstrate sufficient rigidity and stability to comfortably support a seated user.

EXAMPLE DEPLOYABLE CHAIR

FIG. 1A shows a top perspective view of an example chair 100A in an undeployed orientation. In some embodiments, the chair 100A includes a plurality of links connected to one another in a sequence. For example, the chair 100A includes a plurality of links 103A connected to one another in a sequence defining a first portion 101A and a plurality of links 103B connected to one another in a sequence defining a second portion 101B. In various embodiments, adjacent links are connected to each other via pivotable connections 102. In some embodiments, a respective central portion 105 extends between opposing links 103A, 103B of the first portion 101A and second portion 101B. Alternatively, as shown in FIGS. 22A-B, a link comprises a central portion 2214 that extends between opposing ends of the link, and the chair is defined by a single sequence of interlocking links. In some embodiments, the central portions 105 embody slats configured to at least partially overlap or fit into each other.

In some embodiments, the first portion 101A and second portion 101B are connected via the central portions 105. As shown in FIGS. 1A-B, the links 103A, 103B enable the corresponding portion 101A, 101B to transition into a rolled arrangement such that the chair 100A, 100B is configured to an undeployed orientation. In various embodiments, in the undeployed orientation, the chair 100A, 100B demonstrates a reduced spatial footprint and may be easily transported by a subject. For example, a subject may carry the chair 100A, 100B in the undeployed orientation to during transit to a desired deployment site, such as a beach, park, event venue, and/or the like.

In some embodiments, the plurality of links 103A, 103B are configured to partially unroll in a first direction to transition the chair 100A from an undeployed orientation (e.g., shown in FIG. 1A) to a deployed orientation (e.g., as shown in FIG. 7). In some embodiments, the pivotable connection 102 includes a pivot limiting element configured to limit the unrolling of the first and second portions 101A, 101B in the first direction. The limited unrolling of the first and second portions 10A, 101B may maintain the chair 100A in the deployed orientation such that the chair may accommodate a seated subject along the central portions 105. In some embodiments, as shown in FIGS. 1A, B through FIG. 16, the pivot limiting element embodies a tensile connection between adjacent links such that the links are constrained to a maximum angle relative to each other. Additionally, or alternatively, in some embodiments, the pivot limiting element embodies an angular stop formed between opposing surfaces of adjacent links (see, for example, FIGS. 17A-B, 18A-B, and 19).

In some embodiments, the first portion 101A and second portion 101B are positioned in parallel planes relative to one another. The parallel planes may be spaced apparat relative to one another by a distance equal to a respective length of the central portions 105. In some embodiments, the links 103A, 103B embody interlocking tension elements. For example, the first portion 101A and second portion 101B may each include a set of tension elements (e.g., links 103A or 103B) secured at opposing ends of the corresponding portion. The tension elements of a respective set may be oppositely biased relative to one another. In some embodiments, in the deployed orientation, the opposite biasing of the respective sets of tension elements oppose free unrolling of the corresponding portion 101A or 101B in the first direction.

In some embodiments, the chair 100A, 100B includes support legs 107A, 107B. In some embodiments, the support legs 107A, 107B are rotatable between a perpendicular orientation (e.g., shown in FIG. 1B) and a parallel orientation (e.g., shown in FIGS. 4AB through 11A-B). In various embodiments, in the perpendicular orientation, the support legs 107A, 107B are orthogonal to the first and second portions 101A, 101B. In the parallel orientation, the support legs 107A, 107B are parallel to the first and second portions 101A, 101B. In some embodiments, the perpendicular orientation reduces a spatial footprint of the support legs 107A, 107B to further facilitate ease and comfort of transporting the chair 100A, 100B in the undeployed orientation. In some embodiments, when configured to the parallel orientation, the support legs 107A, 107B provide rotational stability to the chair. Further, in the parallel orientation, the support legs 107A, 107B may provide a central point about which the first and second portions 101A, 101B may unroll and roll to transition the chair between deployed and undeployed orientations.

While not shown in FIGS. 1A-B, the chair 100A, 100B may include a carrying strap operatively connected to the first portion 101A and second portion 101B. The carrying strap may further improve the ease of transporting the chair in the undeployed orientation. In some embodiments, the carrying strap comprises one or more loops configured to secure over the first portion 101A, second portion 101B, central portions 105, and/or the like to prevent free unrolling of the first and second portions 101A, 101B. In some embodiments, the carrying strap secures into one or more slots 109 on respective ends of the first and second portions 101A, 101B.

FIGS. 2A-B show, respectively, a left-side view and a right-side view of an example chair 100A, 100B in an undeployed orientation. In various embodiments, adjacent links 103A, 103B of a portion 101 include a pivotable connection 102 that enables unrolling of the portion 101 in a first direction and rolling of the portion 101 in a second direction opposite the first direction. In some embodiments, the pivotable connection 102 between adjacent links includes a pivot limiting mechanism configured to limit rotation of a first link respective to an adjacent link to constrain unrolling of the portion 101 in a first direction. In some embodiments, the pivot limiting mechanism includes one or more tension elements 201 that are secured between adjacent links. For example, a tension element 201 may be connected to the link 103A at a first end and connected to the link 103B at a second end that is opposite the first end. Alternatively, in some embodiments, one or more tension elements 201 are threaded continuously through a plurality of links embodying a respective portion. For example, a respective portion may comprise a plurality of interlocking links between a first end and a second end. One or more tension elements 201 may be secured to the first end, threaded through the plurality of interlocking links, and secured to the second end.

In some embodiments, the attachment between the tension element 201 to a link may include one or more knots, adhesive, stitching, welding, integral formation, and/or the like. In some embodiments, a plurality of tension elements 201 are connected between adjacent links. In some embodiments, the tension element 201 includes elastic, semi-elastic, or in elastic material. In some embodiments, the tension element 201 comprises one or more cords. For example, the tension element 201 may comprise a plurality of braided cords. In some embodiments, a cord comprises aramid fibers.

In some embodiments, a length of the tension element 201 defines a maximum degree of pivot between adjacent links 103A, 103B. In some embodiments, the tension elements secured between different pairs of adjacent links comprise the same length. Alternatively, in some embodiments, the tension elements secured between different pairs of adjacent links comprise variable lengths that enable variable pivoting limitations along the corresponding portion formed by the interlocking links. For example, a subset of links of the portion 101 may be connected by tension elements of a first length that enable a first maximum pivot angle, and a second subset of links of the portion 101 may be connected by tension elements of a second length associated with a second maximum pivot angle. The first length may be greater than the second length, and, as a result, the first maximum pivot angle may be greater than the second pivot angle. The varying pivot angles may enable unrolling of the portion 101 into a shape configured for accommodating a seated profile of a subject. For example, a subset of interlocking links defining a central section of the portion 101 may include tension elements of the second length. Additional subsets of interlocking links defining sections extending from either end of the central section may include tension elements of the first length. The second length may cause orientation of the central section into a suitable curvature for conforming to a profile of a seated subject. The first length may cause the sections extending from the central section to deploy into substantially flat planes for accommodating and supporting the legs and back of a subject.

FIGS. 3A-D show, respectively, top, bottom, front, and back views of an example chair 100A, 100B, 100C, 100D in an undeployed orientation.

FIGS. 4A-B show, respectively, a top perspective view and a bottom perspective view of an example chair 100A, 100B in a partially deployed orientation. As shown, respective sections 401A, 401B of the first and second portions 101A, 101B and a subset of the central portions 105 may unroll to a deployed position. In the deployed position, the sections 401A, 401B and subset of central portions 105 may define a surface for supporting the legs of a seated subject. As further shown in in FIG. 8, sections 801A, 801B of the first and second portions 101A, 101B and a second subset of the central portions 105 may unroll to a deployed position for supporting the back of a seated subject.

In various embodiments, the respective sections 401A, 401B of the first and second portions 101A, 101B articulate into the deployed orientation via rotation of links about the pivotable connection 102. For example, a plurality of interlocking links 103 may define the section 401B. To transition the section 401A from an undeployed orientation to a deployed orientation, the interlocking links 103 may pivot about their respective pivotable connections 102. One or more pivot limiting mechanisms may constrain the respective angle of each pivotable connection 102. For example, the maximum angle of the pivotable connection 102 between adjacent links 103 may be constrained by one or more oppositely biased tension elements 201 between the adjacent links. In various embodiments, in the partially deployed orientation, the supports legs 107A, 107B of the chair are rotated to a parallel orientation. In some embodiments, the support legs 107A, 107B extend in a direction opposite a deployment direction of the sections 401A, 401B. In various embodiments, each portion 101 includes an anchor link 501. In various embodiments, a support leg is attached to the anchor link 501 of each portion such that the support leg may rotate about the anchor link 501.

FIGS. 5A-B show, respectively, a left-side view and a right-side view of an example chair 100A, 100B in a partially deployed orientation. As shown, a section 401 of the portion 101 may include a plurality of interlocking links 103 rotated from an undeployed orientation (e.g., shown in FIGS. 1A-B through 3A-D) to a deployed orientation. In some embodiments, the section 401 defines a profile of a leg rest portion of the chair 100A, 100B. In some embodiments, the section 401 defines at least a partial profile of a seating portion of the chair 100A, 100B. In some embodiments, pivot limiting mechanisms maintain maximum pivot angles of the respective pivotable connections 102 between adjacent links 103. For example, one or more sets of tension elements 201 secured between adjacent links 103 may constrain the links from pivoting about the pivotable connection 102 beyond a predetermined maximum angle. In some embodiments, the length of the tension element 201 is configured to provide a predetermined maximum angle. In some embodiments, the respective tension elements of different pairs of adjacent links 103 demonstrate variable lengths. For example, a first set of tension elements may be secured between a first pair of interlocking links 503A, 503B and a second set of tension elements may be secured between a second pair of interlocking links 505A, 50B. The first set of tension elements may demonstrate a shorter length as compared to the length of the second set of tension elements. The shorter length of the first set of tension elements may cause the first pair of interlocking links 503A, 503B to demonstrate a lesser pivot angle as compared to the second pair of interlocking links 505A, 505B.

FIGS. 6A-D show, respectively, top, bottom, front, and back views of an example chair 100A, 100B, 100C, 100D in a partially deployed orientation.

FIG. 7 shows a top perspective view of an example chair 100 in a deployed orientation in accordance with at least some embodiments of the present disclosure. In various embodiments, the first and second portions 101A, 101B comprise respective lengths defining opposing ends 702A, 702B of the corresponding portion. In some embodiments, in the deployed orientation, the respective sets of interlocking links of the first portion 101A and the second portion 101B maintain a maximum separation length 701 between the opposing ends 702A, 702B of the corresponding portion. In various embodiments, the plurality of central portions 105 are operatively connected to the first and second portions 101A, 101B such that the first and second portions are positioned in parallel planes relative to one another. In some embodiments, the parallel planes are spaced apart relative to one another by a distance equal to a length 704 of a central portion 105.

As described herein, the first and second portions 101A, 101B may each comprise a set of tension elements 201 secured at the opposing ends 702A, 702B of the corresponding portion. For example, the first portion 101A may include a plurality of interlocking links that extend along the length between the opposed ends 702A, 702B of the portion. In some embodiments, the set of tension elements 201 extend through the plurality of interlocking links and are secured at terminal links at each of the opposed ends 702A, 702B. Additionally, in such embodiments, the tension elements 201 may be further secured at respective links between the terminal links. Alternatively, in some embodiments, a set of tension elements may be secured between adjacent links along the length of the portion. For example, one or more cords may be secured between each pair of adjacent links along the length of the first portion 101A. In various embodiments, the set of tension elements are oppositely biased to one another. In some embodiments, the opposite biasing of the set of tension elements opposes free unrolling of the corresponding portion in the first direction. For example, the sets of tension elements 201 between adjacent links may oppose pivoting of the links about the pivotable connection 102 beyond a predefined angle such that the corresponding portion may articulate into a curved structure without further articulating into a substantially flat structure.

In some embodiments, the chair 100 includes a seating portion 705 and a backrest portion 707. In various embodiments, respective subsets of the interlocking links of the first and second portions 101A, 101B define each portion 705, 707. In some embodiments, an anchor link 501 defines a transition between the seating portion 705 and the backrest portion 707. In some embodiments a quantity of interlocking links that defines the backrest portion 707 exceeds a quantity of links that define the seating portion 705 such that a length of the backrest portion 707 exceeds a length of the seating portion 705. Alternatively, in some embodiments, the quantity of interlocking links that defines the seating portion 705 exceeds the quantity of links that define the backrest portion 707 such that the length of the seating portion 705 exceeds the length of the backrest portion 707.

In various embodiments the central portions 105 secured between aligned links of the first and second portions 101A, 101B define a surface of the seating portion 705 and backrest portion 707. The central portions 105 may embody rods, slats, and/or the like. In some embodiments, a respective central portion 105 embodies a rod comprising a multi-layer cylinder. In some embodiments, the multi-layer cylinder comprises an inner structural layer and an outer cushioning layer surrounding the structural layer. In some embodiments, the structural layer provides rigidity and the cushioning layer increases comfort of subject seated in the chair 100. In some embodiments, a flexible cover is secured over the central portions 105. For example, a canvas may be attached to each central portion 105 to further define the surfaces of the seating portion 705 and backrest portion 707. The flexible cover may be secured to the central portions via stitches, welding, adhesives, snap fasteners, hook and loop fasteners, and/or the like. In some embodiments, a rigid handle is integrated into the flexible cover to improve ease of carrying the chair 100 in the deployed or undeployed orientations.

FIG. 8 shows a bottom perspective view of an example chair 100 in a deployed orientation. In some embodiments, in the deployed orientation, the support legs 107A, 107B are rotated from a perpendicular orientation to a parallel orientation. In some embodiments, the support legs 107A, 107B include a locking mechanism configured to secure the rotational orientation of the support leg. For example, the support leg 107A may include a locking mechanism configured to secure the support leg in the perpendicular orientation, parallel orientation, and/or the like.

FIG. 9 shows a side view of an example chair 100 in a deployed orientation. FIG. 9 further illustrates oppositely biased sets of tension elements that may be secured between adjacent links of the portion 101. For example, sets of tension elements 901A, 901B, 901C may be attached between adjacent links 103A and 103B, 103B and 103C, and 103C and 103D, respectively. In some embodiments, the sets of tension elements are of the same or different lengths. In some embodiments, one or more sets of tension elements are adjustable in length such that one or more angular orientations of the chair 100 may be adjusted. For example, the respective length of one or more sets of tension elements of the portion 101 may be lengthened or shortened to adjust an angular orientation of the seating portion 705, an angular orientation of the backrest portion 707, or an angular orientation between the seating portion 705 and back portion 707. In some embodiments, the length of a set of tension elements may be adjustable via a ratcheting mechanism, drawstring mechanism, slider mechanism, and/or the like.

FIGS. 10A-B show, respectively, a top and bottom view of an example chair 100A, 100B in a deployed orientation.

FIGS. 11A-B show, respectively, a front and back view of an example chair 100A, 100B in a deployed orientation.

FIG. 12 shows a perspective view of a portion 101 of an example chair in a deployed orientation. In some embodiments, a set of tension elements 801 is secured between adjacent links 103A, 103B. In some embodiments, the set of tension elements 801 includes a plurality of tension elements 1201A, 1201B, 1201C, 1201D, 1201E. In various embodiments, the tension elements 1201A, 1201B, 1201C, 1201D, 1201E are separated from one another by a respective separation distance 1202. In some embodiments, a link includes a plurality of voids configured to receive respective ends of a set of tension elements. In some embodiments, the voids are horizontally distributed to provide the separation distance 1202 between adjacent tension elements.

FIGS. 13A-B show, respectively, a left-side view and a right-side view of a portion 101A, 101B of an example chair in a deployed orientation.

FIGS. 14A-B show, respectively, a top view and a bottom view of a portion 101A, 101B of an example chair in a deployed orientation. In various embodiments, a section line 1401 indicates a cross section 1500 shown in FIG. 15.

FIG. 15 shows a cross-section 1500 of a portion 101 of an example chair in a deployed orientation. In some embodiments, a link includes one or more channels 1501 and one or more pivot voids 1503. In some embodiments, a pivotable connection 102 between adjacent links 103A, 103B comprises a channel 1501 of the link 103A and a pivot void 1503 of the link 103B. In some embodiments, a cord, cable, band, and/or the like is inserted through the channel 1501 and pivot void 1503 of adjacent links to pivotable connect the links. For example, a pivotable connection 102 between the links 103A, 103B may comprise the channel 1501 of the link 103A, the pivot void 1503 of the link 103B, and a cord, cable, band, and/or the like inserted through the channel 1501 and pivot void 1503. In some embodiments, the cord, cable, band, and/or the like is threaded through the channels and voids of all or a subset of the links of the portion 101. For example, a cord, cable, band, and/or the like may be threaded through the channels and pivot voids of the plurality of links that embody the portion 101. The opposing ends of the cord, cable, band, and/or the like may be secured at links embodying the opposed ends 702A, 702B, respectively.

In some embodiments, a link includes two or more sets of channels and pivot voids. For example, a link may include a first channel 1501 aligned with a first pivot void 1503 and a second channel 1501 aligned with a second pivot void 1503. The first channel and pivot void may be laterally separated from the second channel and pivot void by a separation distance such that the first and second channels and pivot voids lie in respective parallel planes. In some embodiments, a cord, cable, band, and/or the like may be threaded through a first set of aligned channels and pivot voids of a plurality of links. The cord, cable, band, and/or the like may be then threaded through a second set of aligned channels and pivot voids of the plurality of links, where the second set is laterally displaced from the first set.

FIG. 16 shows a deployment sequence of an example chair 100A, 100B, 100C, 100D. In various embodiments, the chair 100A shown in FIG. 16 embodies the example chairs shown in FIGS. 1A-B, 2A-B, and 3A-D. The chair 100B shown in FIG. 16 may embody the example chairs shown in FIGS. 4A-B, 5A-B, and 6A-D. The chair 100D may embody the example chairs shown in FIGS. 7, 8, 9, 10A-B, and 11A-B.

In some embodiments, the sequence 1600 includes blocks 1601, 1603, 1605, and 1607. In some embodiments, at block 1601, the chair 100A is configured to an undeployed orientation. For example, the first and second portions 101 of the chair 100A may be in a rolled configuration to reduce the spatial footprint of the chair 100A and facilitate ease of carrying, stowing, and/or the like. In some embodiments, a cover secured over the central portions of the chair 100A includes one or more releasable fasteners configured to maintain the rolled configuration. In some embodiments, at block 1601, the support legs 107A of the chair 100A are configured to a perpendicular orientation.

In some embodiments, at block 1603, the chair 100A is transitioned to a partially deployed orientation represented by the chair 100B. In some embodiments, in the partially deployed orientation, the section 401 unrolls in a first direction until the pivot limiting mechanisms of the interlocking links comprising the section engage to oppose further unrolling of the section in the first direction. In some embodiments, at block 1605, the chair 100B is further transitioned to a partially deployed orientation represented by the chair 100C. In some embodiments, at block 1603, the support legs 107B are rotated from the perpendicular orientation to a parallel orientation such that the support legs define a stable base of the chair 100C. In some embodiments, at block 1607, the chair 100C is transitioned to a fully deployed orientation embodied as the chair 100D. In various embodiments, at block 1608, the chair is transitioned via unrolling of respective second sections 1604 of the one or more portions 101. In some embodiments, the second section 1604 unrolls in a second direction that is opposite the direction in which the section 401 unrolls. In some embodiments, the second section 1604 unrolls in the second direction until the pivot limiting mechanisms of the interlocking links comprising the section engage to oppose further unrolling of the section in the second direction.

FIGS. 17A-B show, respectively, perspective views of an example portion 1700A, 1700B of a chair in an undeployed orientation (FIG. 17A) and a deployed orientation (FIG. 17B). In various embodiments, a chair of the present disclosure comprises one or more portions comprising a plurality of links pivotably connected to one another in a sequence. For example, a portion 1700A may include links 1703A, 1703B, 1703C that are pivotably connected to one another in a sequence via pivotable connections 102A, 102B.

In some embodiments, a respective link includes a first end 1705 and a second end 1707 that is opposite the first end 1705. In some embodiments, each end 1705, 1707 comprises one or more rings 1702. In some embodiments, a respective end includes a plurality of aligned rings 1702 spaced apart from one another. In such embodiments, respective voids 1704 between the rings 1702 of a particular link are configured to receive rings of an end of an adjacent link. For example, a volume of empty space between two rings 1702 of an end 1705 of a first link may define a void 1704 configured to receive a respective ring 1702 of an end 1707 of a second link. Additionally, in some embodiments, a respective end includes one or more cavities 1706 configured to receive a respective ring 1702 of another link.

For example, the link 1703B may include a first end 1705 and a second end 1707 opposite the first end 1705. The first end 1705 may include a first plurality of spaced rings 1702 that define a plurality of voids 1704 and one or more cavities. The second end 1707 may include a second plurality of spaced rings 1702 that define a second plurality of voids 1704 and one or more cavities. The first plurality of voids 1704 and one or more cavities 1706 of the first end 1705 may receive a plurality of rings 1702 of an end 1707 of the link 1703A. The second plurality of voids 1704 and one or more cavities 1706 of the second end 1707 may receive a plurality of rings 1702 of an end 1705 of the link 1703C. The end 1707 of the link 1703A may receive the plurality of rings 1702 of the end 1705 of the link 1703B. The end 1705 of the link 1703C may receive the plurality of rings 1702 of the end 1707 of the link 1703C.

In some embodiments, the pivotable connection between adjacent links comprises an aligned arrangement of the rings of the links. For example, a pivotable connection 102A between the link 1703A and link 1703B may comprise the second end 1707 of the link 1703A and the first end 1705 of the link 1703B. The pivotable connection 102A may include an aligned arrangement of the respective rings 1702 of the end 1707 of the link 1703A and the end 1705 of the link 1703B. In some embodiments, the aligned arrangement is maintained via a pin 1710 inserted through the aligned rings.

In some embodiments, a pivotable connection between adjacent links comprises a pivot limiting element 1709 configured to limit unrolling of the corresponding portion of the chair in a first direction. In some embodiments, the pivot limiting element 1709 embodies one or more sets of tension elements as shown in FIGS. 1A, B through FIG. 16 and described herein. Additionally, or alternatively, in some embodiments, the pivot limiting element 1709 comprises an angular stop formed between a surface 1712A, B of a first adjacent link and a surface 1714A, B of a second adjacent link. In some embodiments, surfaces 1712A, 1714A of adjacent links are out of contact when the links are positioned within a predetermined angular range. The predetermined angular range may correspond to articulation of the portion of the chair between an undeployed orientation and a deployed orientation as shown in the sequence 1600. For example, as shown in FIG. 17A, the surfaces 1712A, 1714A of the adjacent links 1703A, 1703B may be out of contact when the portion 1700A is in an undeployed or partially deployed orientation. During transition of the portion 1700A to the orientation represented by the portion 1700B, the adjacent links 1703A, 1703B may pivot about the pivotable connection 102A until the surfaces 1712B, 1714B come into contact to form an angular stop such that further rotation in the first direction about the pivotable connection 102A is opposed. When the surfaces 1712B, 1714*b* are in contact, the portion 1700B may be in a deployed orientation.

In some embodiments, the portion 1700A, 1700B includes a plurality of central portions 105. In some embodiments, a central portion 105 embodies a slat. For example, a plurality of central portions 105 may embody a set of slats that optionally fit into or overlap one another when the chair is configured to a deployed orientation. In some embodiments, the central portions 105 are connected to a first portion on a first side and a second portion on a second side that is opposite the first side. For example, a chair may include a first portion 1700A having a first length defining opposing ends of the first portion 1700A. The chair may further include a second portion 1700A having a second length equal to the first length, the second length defining opposing ends of the second portion 1700A. The chair may include a plurality of central portions 105 operatively connected to the first portion 1700A and the second portion 1700A along the first and the second lengths thereof respectively, such that the first portion 1700A and the second portion 1700A are positioned in parallel planes relative to one another (e.g., the parallel planes spaced apart relative to one another by a distance equal to a length of each of the plurality of central portions). In some embodiments, one or more central portions 105 are integrally formed with one or more portions. For example, a central portion may be integrally formed with one or more links comprising a respective portion 1700A.

FIGS. 18A-B show, respectively, side views of an example portion 1800A, 1800B of a chair in undeployed and deployed orientations. A portion 1800A, 1800B may include a plurality of interlocking links 1703A, 1703B, 1703C. The portion 1800A may represent a configuration corresponding to an undeployed chair orientation. For example, in FIG. 18A, the pivotable connections 102A, 102B between adjacent links 1703A, 1703B, 1703C may enable the portion 1800A to at least partially unroll in a first direction to transition the chair from an undeployed orientation to a deployed orientation. The portion 1800B may represent a configuration corresponding to a deployed chair orientation. For example, in FIG. 18B, a respective pivotable connection may comprise an angular stop formed between the contacting surfaces 1712A,B and 1714A,B of a pair of adjacent links.

FIG. 19 shows a perspective view of an example portion 1900 of a chair in a deployed orientation. In some embodiments, the portion 1900 includes a plurality of links 1901, 1903, 1905 connected to another in a sequence. In some embodiments, a respective link comprises a central portion 1907 that extends between a set of opposed ends 1902, 1904 of the link. In some embodiments, adjacent links include pivotable connections that enable pivoting of links about one another such that the portion 1900 may roll and partially unroll to transition the chair between undeployed and deployed orientations. For example, the link 1901 may be pivotably connected to the link 1903 (shown as pivotable connection 102A in FIG. 19), and the link 1903 may be further pivotably connected to the link 1905 (shown as pivotable connection 102B in FIG. 19).

In some embodiments, a respective link includes a set of rings along an end of the link. In some embodiments, the link includes a second set of rings along an opposite end of the link. For example, the link 1901 further include a set of opposed ends 1906, 1908. The link 1901 may include a set of rings 1909A along the end 1906 and a second set of rings 1911 along the opposite end 1908. In some embodiments, respective rings of a set of rings are spaced by a separation distance such that a void 1912 is present between adjacent rings of the set. Additionally, in some embodiments, a ring is spaced apart from a respective end 1902, 1904 of the link such that a cavity 1910 is present between the ring and the corresponding end of the link.

In some embodiments, a void 1912 receives a ring of an adjacent link such that respective rings of the adjacent links are in an aligned arrangement. In some embodiments, the aligned arrangement is maintained via a pin inserted through the aligned rings. For example, the pivotable connection 102A between the links 1901, 1903 may included an aligned arrangement of the rings 1911 of the link 1901 and rings 1909B of the link 1903, where the aligned arrangement is maintained via a pin 1914 inserted through the respective rings.

FIG. 20 show a perspective view of an example portion 101 of a chair in a deployed orientation. In some embodiments, a portion 101 comprises a plurality of interlocking links 103A, 103B. In some embodiments, the portion 101 comprises a plurality of integrally formed links 2002 between the interlocking links 103A, 103B. For example, a chair may include a first portion 101 and a second portion 101 spaced apart from the first portion. The chair may further include central portions (e.g., central portions, rods, slats, and/or the like) secured between the first and second portions. A respective portion may comprise a plurality of tension elements secured at opposing ends of the portion 1900. The plurality of tension elements may include a first subset of links for defining a backrest portion and a second subset of links for defining a seating portion.

In some embodiments, the portion 101 comprises a first set of links 2001, a second set of links 2003, and a third set of links 2005 between the first and second sets of links 2001, 2003. In some embodiments, the third set of links 2005 comprises plurality of integrally formed links 2006A, 2006B, 2006C, 2007D, 2006E, 2006F (2006A-F). In some embodiments, the links 2006A-F embody a semi-rigid arch. For example, the links 2006A-F may be configured to at least partially flex relative to one another. In various embodiments, a terminal link 2009 of the first set of links 2001 is pivotably connected to a first end of the third set of links 2005. In some embodiments, a terminal link 2011 of the second set of links 2003 is connected to a second end of the third set of links 2005. In some embodiments, the pivotable connection comprises a pivot limiting mechanism. For example, the pivot limiting mechanism comprises a set of tension elements, such as a set of tension elements 201 as shown in FIG. 2 and described herein. Additionally, or alternatively, the pivot limiting mechanism comprises an angular stop comprised of adjacent surfaces of the adjacent links. For example, the pivot limiting mechanism may embody an angular stop comprised of adjacent surfaces 1712A, 1714A as shown in FIG. 17A and described herein.

In some embodiments, a respective link of the portion 101 includes a first channel 1501A and a second channel 1501B spaced apart and parallel to the first channel 1501B. In some embodiments, the respective channels 1501A, 1501B are configured to receive a tension element (e.g., cable, cord, and/or the like) such that the tension element may be passed through corresponding channels of adjacent links to thread the tension element through the length of the portion 101. In some embodiments, the channels 1501A, 1501B enable securing of the links to one another. In some embodiments, the links 2006A-F of the third set of links 2005 include a first and a second integrally formed channel extending through the length of the integrally formed links (e.g., the first and second integrally formed channels being spaced apart and parallel to one another).

FIGS. 21A-B show, respectively, a side view and cross-section 2100 of an example portion 101 of a chair in a deployed orientation. In some embodiments, a section line 2101 indicates the cross-section 2100 of FIG. 21B. In various embodiments, the cross-section 2100 shows the respective channels extending through the links of the first set of links 2001, second set of links 2003 and third set of links 2005. As shown, the integrally formed links of the third set of links 2005 may include one or more continuous channels 1501 extending through the length of the set. In some embodiments, the third set of links 2005 includes a continuous top surface that extends along and between respective top portions 2103 of the links. In some embodiments, one or more channels 1501 extends through respective bottom portions 2105 of the links of the third set of links 2005. In some embodiments, the respective bottom portions 2105 of the third set of links 2005 are integrally formed with a base 2107. In some embodiments, the base 2107 is configured to provide structural support to the third set of links 2005. For example, the base 2107 may limit flexion of the integrally formed links. In some embodiments, one or more support legs 107 are secured to the base 2107 such that the support leg may rotate between a perpendicular position (e.g., in an undeployed chair orientation) and a parallel position (e.g., in a deployed chair orientation).

In some embodiments, adjacent links of the first set of links 2001 and adjacent links of the second set of links include, respectively, a pivot limiting mechanism comprising sets of tension elements secured between the adjacent links. In some embodiments, a pivot limiting mechanism between a terminal link 2110 of the first set of links 2001 and a link 2006A of the third set of links 2005 comprises a set of tension elements secured between the links. A pivot limiting mechanism between a terminal link 2112 of the second set of links 2003 and a link 2006F of the third set of links 2005 may comprise a set of tension elements secured between the links. Additionally, or alternatively, in some embodiments, one or more pivot limiting mechanisms between the sets of adjacent links 2001 and 2005 or 2003 and 2005 comprise an angular stop.

FIGS. 22A-B show perspective views of an example chair 2200 and portion 2201 thereof in a deployed orientation. In some embodiments, the chair 2200 includes a portion 2201 including a plurality of interlocking links. For example, a first link 2203 may be pivotably connected to a second link 2205, and the second link 2205 may be further pivotably connected to a third link 2207. In some embodiments, the pivotable connection between adjacent links comprises one or more angular stops. Additionally, or alternatively, the pivotable connection comprises one or more sets of tension elements secured between the adjacent links. For example, as shown in FIG. 22B, a set of tension elements 201 may secured between adjacent links.

In some embodiments, a link includes a first end 2210, a second end 2212 opposite the first end, and a central portion 2214 extending between the first end 2210 and second end 2212. In various embodiments, the first end 2210, second end 2212, and central portion 2214 are integrally formed. In some embodiments, the link is pivotably connected to an adjacent link at each of the first end 2210 and the second end 2212. Additionally, or alternatively, in some embodiments, the link includes one or more pivotable connections along the central portion 2214. For example, a link may include a plurality of pivotable connections along a central portion, such as in pivotable links of the example portion 1900 shown in FIG. 19 and described herein. In some embodiments, the central portion 2214 of the links embody slats configured to at least partially overlap or fit into one another.

FIG. 23 shows a perspective view of an example portion 2300 of a chair. In some embodiments, the portion 2300 includes a plurality of interconnected links. For example, the portion 2300 may include interconnected links 2301A, 2301B, 2301C, 2301D. The pivotable connections between the links 2301A, 2301B, 2301C, 3201D may comprise channels 1501 and voids 1503 as shown in FIG. 15 and described herein, where said channels and voids are connected by one or more inserted cables, cords, bands, and/or the like as described herein.

In some embodiments, one or more pivot limiting mechanisms may constrain the respective angle of each pivotable connection. In some embodiments, a respective link includes a first void 2303 spaced apart from a second void 2305. In some embodiments, the link includes a pin 2307 inserted through the first and second voids 2303, 2305. In various embodiments, a pivot limiting mechanism between adjacent links comprises one or more tension elements secured over the respective pins of the adjacent links. For example, a pivot limiting mechanism between the links 2301A, 2301B may include tension elements 2309A, 2309B, 2309C secured over the respective pin 2307 of each link. A respective tension element may comprise a closed loop extending around the respective pins of the adjacent links. In some embodiments, the tension element comprises one or more metallic materials, one or more polymer materials, one or more fibrous materials, and/or the like. In various embodiments, in the deployed orientation, a respective tension element constrains a pivot angle between adjacent links to a predetermined range. For example, the tension elements 2309A, 2309B, 2309C may constrain a pivot angle of adjacent links 2301A, 2301B to a maximum value.

While various aspects have been described, additional aspects, features, and methodologies of the claimed apparatuses will be readily discernible from the description herein, by those of ordinary skill in the art. Many embodiments and adaptations of the disclosure and claimed inventions other than those herein described, as well as many variations, modifications, and equivalent arrangements and methodologies, will be apparent from or reasonably suggested by the disclosure and the foregoing description thereof, without departing from the substance or scope of the claims. Furthermore, any sequence(s) and/or temporal order of steps of various processes described and claimed herein are those considered to be the best mode contemplated for carrying out the claimed inventions. It should also be understood that, although steps of various processes may be shown and described as being in a preferred sequence or temporal order, the steps of any such processes are not limited to being carried out in any particular sequence or order, absent a specific indication of such to achieve a particular intended result. In most cases, the steps of such processes may be carried out in a variety of different sequences and orders, while still falling within the scope of the claimed inventions. In addition, some steps may be carried out simultaneously, contemporaneously, or in synchronization with other steps.

The embodiments were chosen and described in order to explain the principles of the claimed inventions and their practical application so as to enable others skilled in the art to utilize the inventions and various embodiments and with various modifications as are suited to the particular use contemplated. Alternative embodiments will become apparent to those skilled in the art to which the claimed inventions pertain without departing from their spirit and scope. Accordingly, the scope of the claimed inventions is defined by the appended claims rather than the foregoing description and the exemplary embodiments described therein.

What is claimed is:

1. An apparatus, comprising:

a plurality of links pivotably connected to one another in a sequence, wherein each link comprises a central portion extending between opposing ends of the link, wherein the plurality of links are configured to at least partially unroll in a first direction to transition the apparatus from an undeployed orientation to a deployed orientation; and the pivotable connection between respective links embodying at least one pivot limiting element configured to limit the unrolling of the apparatus in the first direction, wherein:

the opposing ends of each of the plurality of links define, respectively, a first portion and a second portion that are positioned in parallel planes relative to one another, the parallel planes spaced apart relative to one another by a distance equal to a length of the central portion, the at least one pivot limiting element comprises: a first set of tension elements secured at at least opposing ends of the first portion; and a second set of tension elements secured at at least opposing ends of the second portion, the first and second set of tension elements maintain a maximum separation distance between the respective opposing ends of the first portion and the second portion, and the first and second set of tension elements each comprise a plurality of cords secured between the opposing ends, wherein each of the plurality of cords of each tension element is separated from one another by a separation distance.

2. An apparatus, comprising:

a first portion having a first length defining opposing ends of the first portion;

a second portion having a second length equal to the first length, the second length defining opposing ends of the second portion; and a plurality of central portions operatively connected to the first portion and the second portion along the first and the second lengths thereof respectively, such that the first portion and the second portion are positioned in parallel planes relative to one another, the parallel planes spaced apart relative to one another by a distance equal to a length of each of the plurality of central portions, wherein:

each of the first portion and the second portion comprises:

a plurality of segments between the opposing ends; and a plurality of sets of tension elements; and a respective set of the plurality of sets of tension elements is secured between adjacent segments of the plurality of segments, the respective set of tension elements being oppositely biased relative to one another;

the first portion and the second portion are configured to at least partially unroll in a first direction to transition the apparatus from an undeployed orientation to a deployed orientation;

in the deployed orientation the opposite biasing of the respective sets of tension elements opposes free unrolling of the corresponding portion in the first direction; and the plurality of sets of tension elements each comprise a plurality of cords secured between the opposing ends, wherein each of the plurality of cords of each tension element is separated from one another by a separation distance.

3. The apparatus of claim 2, wherein:

in the deployed orientation, the respective sets of tension elements each maintain a maximum separation length between the opposing ends of the first portion and the second portion, respectively.

4. The apparatus of claim 2, further comprising:

a first support leg attached to the first portion; and a second support leg attached to the second portion at a position parallel to the first support leg attached to the first portion, wherein:

each of the first support leg and the second support leg are rotatable between a first position that is perpendicular to the corresponding portion and a second position that is parallel to the corresponding portion; and the first support leg and the second support leg are configured to be rotated to the second position while the apparatus is in the deployed orientation.

5. The apparatus of claim 2, wherein:

the plurality of segments of the first portion comprises a first plurality of interlocking links that extend along the first length between the opposing ends of the first portion; and the plurality of segments of the second portion comprises a second plurality of interlocking links that extend along the second length between the opposing ends of the second portion.

6. The apparatus of claim 5, wherein:

the opposing ends of the first portion comprise a first end and a second end, the first and the second ends being embodied, respectively, by a first link of the first plurality of interlocking links and a second link of the first plurality of interlocking links; and the opposing ends of the second portion comprise a first end and a second end, the first and the second ends being embodied, respectively, by a first link of the second plurality of interlocking links and a second link of the second plurality of interlocking links.

7. The apparatus of claim 5, wherein:

each of the plurality of central portions is operatively connected to a respective pair of links from the first and the second plurality of interlocking links.

8. The apparatus of claim 7, wherein:

each of the plurality of central portions embodies a rod; and a respective rod of the plurality of rods embodies a multi-layer cylinder comprising:

a structural layer; and a cushioning layer surrounding the structural layer.

9. An apparatus, comprising:

a first portion having a first length defining opposing ends of the first portion;

a second portion having a second length equal to the first length, the second length defining opposing ends of the second portion; and a plurality of central portions operatively connected to the first portion and the second portion along the first and the second lengths thereof respectively, such that the first portion and the second portion are positioned in parallel planes relative to one another, the parallel planes spaced apart relative to one another by a distance equal to a length of each of the plurality of central portions, wherein:

each of the first portion and the second portion comprises:

a plurality of segments between the opposing ends; and a plurality of sets of tension elements; and a respective set of the plurality of sets of tension elements is secured between adjacent segments of the plurality of segments, the respective set of tension elements being oppositely biased relative to one another;

the first portion and the second portion are configured to at least partially unroll in a first direction to transition the apparatus from an undeployed orientation to a deployed orientation; and in the deployed orientation the opposite biasing of the respective sets of tension elements opposes free unrolling of the corresponding portion in the first direction;

the plurality of segments of the first portion comprises a first plurality of interlocking links that extend along the first length between the opposing ends of the first portion;

the plurality of segments of the second portion comprises a second plurality of interlocking links that extend along the second length between the opposing ends of the second portion;

each of the plurality of central portions is operatively connected to a respective pair of links from the first and the second plurality of interlocking links;

each of the plurality of central portions embodies a rod; and the rod embodies a multi-layer cylinder comprising: a structural layer; and a cushioning layer surrounding the structural layer.

10. The apparatus of claim 9, wherein:

in the deployed orientation, the respective sets of tension elements each maintain a maximum separation length between the opposing ends of the first portion and the second portion, respectively.

11. The apparatus of claim 9, wherein:

the opposing ends of the first portion comprise a first end and a second end, the first and the second ends being embodied, respectively, by a first link of the first plurality of interlocking links and a second link of the first plurality of interlocking links; and the opposing ends of the second portion comprise a first end and a second end, the first and the second ends being embodied, respectively, by a first link of the second plurality of interlocking links and a second link of the second plurality of interlocking links.

12. The apparatus of claim 9, wherein:

the respective sets of tension elements of the first and the second portion each comprise a plurality of cords secured between the opposing ends, wherein each of the plurality of cords of each tension element is separated from one another by a separation distance.

13. The apparatus of claim 9, further comprising:

a first support leg attached to the first portion; and a second support leg attached to the second portion at a position parallel to the first support leg attached to the first portion, wherein:

each of the first support leg and the second support leg are rotatable between a first position that is perpendicular to the corresponding portion and a second position that is parallel to the corresponding portion; and the first support leg and the second support leg are configured to be rotated to the second position while the apparatus is in the deployed orientation.

* * * * *